US008206234B1

(12) United States Patent
Slater

(10) Patent No.: US 8,206,234 B1
(45) Date of Patent: Jun. 26, 2012

(54) ACRYLIC PUTTER HEAD

(76) Inventor: Robert F. Slater, North Palm Beach, FL (US)

( * ) Notice: Subject to any disclaimer, the term of this patent is extended or adjusted under 35 U.S.C. 154(b) by 0 days.

(21) Appl. No.: 13/078,671

(22) Filed: Apr. 1, 2011

Related U.S. Application Data

(63) Continuation-in-part of application No. 12/624,910, filed on Nov. 24, 2009, now abandoned.

(60) Provisional application No. 61/117,522, filed on Nov. 24, 2008.

(51) Int. Cl.

| | |
|---|---|
| ***A63B 69/36*** | (2006.01) |
| ***A63B 53/04*** | (2006.01) |
| ***A63B 53/06*** | (2006.01) |
| ***A63B 53/02*** | (2006.01) |

(52) U.S. Cl. ..... 473/244; 473/248; 473/251; 473/313; 473/325; 473/340; 473/341; 473/349

(58) Field of Classification Search ..... 473/324–350, 473/313, 251–256, 244–248
See application file for complete search history.

(56) References Cited

U.S. PATENT DOCUMENTS

| | | | | |
|---|---|---|---|---|
| 1,537,711 | A * | 5/1925 | Spafford | 473/325 |
| 3,019,022 | A * | 1/1962 | Ehmke | 473/240 |
| 3,042,405 | A * | 7/1962 | Solheim | 473/313 |
| 3,043,596 | A * | 7/1962 | Ehmke | 473/240 |
| 3,516,674 | A | 6/1970 | Scarborough | |
| 3,770,279 | A * | 11/1973 | Phinny | 473/313 |
| 3,873,094 | A | 3/1975 | Sebo et al. | |
| 4,444,395 | A | 4/1984 | Reiss | |
| 4,529,202 | A | 7/1985 | Jacobson | |
| 4,898,387 | A * | 2/1990 | Finney | 473/341 |
| 4,979,744 | A | 12/1990 | Alcala | |
| 5,058,895 | A * | 10/1991 | Igarashi | 473/341 |
| 5,078,398 | A * | 1/1992 | Reed et al. | 473/313 |
| 5,308,067 | A | 5/1994 | Cook | |
| 5,324,031 | A | 6/1994 | Green | |
| 5,346,219 | A * | 9/1994 | Pehoski et al. | 473/325 |
| 5,415,399 | A * | 5/1995 | Kettelson | 473/239 |
| 5,630,765 | A * | 5/1997 | Moore | 473/252 |
| 5,683,307 | A * | 11/1997 | Rife | 473/313 |
| 5,746,664 | A | 5/1998 | Reynolds, Jr. | |
| 5,842,935 | A * | 12/1998 | Nelson | 473/342 |
| 5,938,543 | A | 8/1999 | McGeeney et al. | |
| 5,951,412 | A | 9/1999 | Rose et al. | |
| 5,967,902 | A | 10/1999 | Greenquist et al. | |
| 6,059,669 | A * | 5/2000 | Pearce | 473/339 |
| 6,066,053 | A | 5/2000 | Sehemberger | |
| 6,086,484 | A | 7/2000 | Uebelhor | |
| 6,435,975 | B2 * | 8/2002 | Middleton | 473/231 |
| 6,450,894 | B1 | 9/2002 | Sun et al. | |
| 6,530,848 | B2 * | 3/2003 | Gillig | 473/334 |
| 6,699,140 | B1 | 3/2004 | Sun | |

(Continued)

*Primary Examiner* — Sebastiano Passaniti
(74) *Attorney, Agent, or Firm* — Malloy & Malloy, P.L.

(57) ABSTRACT

A golf putter head for mounting on a shaft to create a golf putter club wherein the putter head includes a frame fabricated of a metal and having a toe end cap and heel end cap. The end caps are spaced apart one from the other by at least one rib integral with the toe and heel end caps. The rib and end caps partially defining at least one central body void. An elongated central filler segment fills the central body void and a has a top surface a bottom surface. The central filler segment in combination with the frame defines at least one generally vertically oriented planar ball contacting surface. The central filler segment is fabricated of polymer based material and the frame generates a moment of inertia significantly greater than a body excluding the end caps.

24 Claims, 26 Drawing Sheets

U.S. PATENT DOCUMENTS

| | | | | |
|---|---|---|---|---|
| 6,986,716 | B2 * | 1/2006 | Lukasiewicz et al. | 473/340 |
| 6,988,956 | B2 | 1/2006 | Cover et al. | |
| 7,037,211 | B1 | 5/2006 | Kosovac | |
| 7,108,613 | B1 | 9/2006 | Gordon et al. | |
| 7,182,697 | B2 | 2/2007 | Zamora | |
| 7,367,896 | B2 * | 5/2008 | Jackson | 473/246 |
| 7,407,443 | B2 * | 8/2008 | Franklin et al. | 473/251 |
| 7,494,422 | B2 | 2/2009 | Pegg | |
| 7,594,865 | B2 | 9/2009 | Ines | |
| 7,771,286 | B2 | 8/2010 | Campadore et al. | |
| 2001/0029209 | A1 | 10/2001 | Kosovac | |
| 2002/0098908 | A1 | 7/2002 | James et al. | |
| 2004/0166953 | A1 * | 8/2004 | Grace | 473/251 |
| 2005/0107185 | A1 | 5/2005 | Lu | |
| 2005/0159241 | A1 * | 7/2005 | Hou | 473/340 |
| 2007/0049402 | A1 * | 3/2007 | Sanchez et al. | 473/340 |

* cited by examiner

ACRYLIC PUTTER HEAD

CLAIM OF PRIORITY

This Non-Provisional Utility application is a continuation-in-part of U.S. Non-Provisional application Ser. No. 12/624,910, filed Nov. 24, 2009, now abandoned which is included in its entirety herein and which claims the benefit of U.S. Provisional Patent Application Ser. No. 61/117,522, filed on Nov. 24, 2008, which is incorporated herein in its entirety.

BACKGROUND OF THE INVENTION

1. Field of the Invention

The present invention relates to a golf putter which may or may not include an acrylic golf putter head including a solid metal body of predetermined weight and size conforming to U.S. Golf Association (USGA) rules and regulations while still demonstrating a sufficiently high Moment Of Inertia (MOI) to significantly increase the accuracy of the golf putter, when used.

2. Description of the Related Art

Golf clubs are provided in a variety of material, shapes, dimensions, and weights; each head design having a unique function or advantage.

Golf clubs are used in the sport of golf to hit a golf ball. Each club is composed of a shaft with a lance (grip) and a club head. Woods are used for long-distance fairway shots; irons, the most versatile class used for a variety of shots, and putters, used mainly on the green to roll the ball into the cup.

An important variation in different clubs is loft, or the angle between the club's face and the vertical plane. It is loft that makes a golf ball leave the tee on an ascending trajectory, not the angle of swing; virtually all swings contact the ball with a horizontal motion. The impact of the club compresses the ball, while grooves on the clubface give the ball backspin (a clockwise spin when viewed from a parallel standpoint to the left of the ball). Together, the compression and backspin create lift. The majority of woods and irons are labeled with a number; higher numbers indicate shorter shafts and higher lofts, which give the ball a higher and shorter trajectory.

While the variation of clubs can differ greatly between golfers, a set used to play a round of golf must have no more than 14 clubs. A full set typically consists of a driver, two fairway woods (generally 3-woods and 5-woods, a set of irons from 3 to 9, a pitching wedge, a sand wedge, a putter, and one more club of the player's choice. Many players opt to avoid the 3- and 4-irons (which are more difficult to hit). Another common variation is to use only the 3, 5, 7, and 9 out of the numbered irons. The extra space in the player's bag can then be filled with more woods, easier-to-hit "hybrid" clubs, additional high-loft or intermediate wedges, and/or a specialized chipping club or multiple putters.

Putters are a special class of clubs with a loft not exceeding ten degrees and designed primarily to roll the ball along the grass, generally from a point on the putting green towards the cup. Contrary to popular belief, putters do have a loft (often 5 degrees from truly perpendicular at impact) that helps to lift the ball from any indentation it has made. This increases rolling distance and reduces bouncing over the turf.

Each head has one face that contacts the ball during the stroke. Clubs may have two striking faces; as long as they are identical and symmetrical (some putters and chippers are designed in this fashion, and may be used by left or right-handed players). The overwhelming majority of clubs have only one striking face.

An issue identified with golf clubs is a twisting motion of the club head when swinging the golf club. A moment of inertia (MOI) refers to resistance to a twisting of the club face from alignment as the slightly less than two ounce ball is hit by the twelve ounce club head, if and when slightly mis-hit, or when contacted off the sweet spot. This occurs regularly by amateur golfers, especially with longer putts.

Extensive tests show that a ball mis-hit by as little as ¾ of an inch will impart a side spin, which will cause the ball to fall "off target" by as much as approximately eight inches along a twelve (12) foot putt. This same mis-hit could result in as much as a ten to fifteen percent shortfall in distance. With longer putts this can lead to three-putt greens in addition to the missed one-putt holes.

Currently, golf putters come in two shapes and designs. The blade, which is generally an "L" configuration with a sole plate supporting a usually thin standing face. This shape also commonly has one-to-one and a half-ounce heel and toe weights as part of the face and sole casting. Because the putter head weight, for distance "touch" on fast contoured greens is generally between 11 ounces and 12 ounces, the length for most blade putters is 4.0 to 4.5 inches. This limits the moment arm for the heel and toe section to about 1.25 inches long. Since the formula for calculating Moment of Inertia (MOI) is the total head weight (typically express in grams) times the length of the head squared in centimeters between the center of mass and the "sweet spot," on the face, wherein the MOI is expressed as grams/cm2.

With the blade type design, the MOI of the heel and toe section are computed separately and then added together. The "sweet spot" is the fulcrum point about which the face twists or revolves when mis-hit. Hence, typically MOI of most blade putters is in the range of 3500 to 4000 grams/cm2.

The mallet design is similar, except that the weight is purposely located to the rear of the head, in line with straddling the center of mass and the sweet spot axis. Here, the design rules of the U.S. Golf Association (USGA) come into play in that the head may not be deeper than the head is long, and the face may not be shorter than two-thirds of the head length. Though many mallet designs have a head depth and length of four and five inches, the typical center of mass point has yet to be moved more than 1.6 inches back from the face; even though extremely thin plates or aluminum rings are used to support the "back weighting." Hence, the typical MOI for the mallet design is 4500 to 5000 grams/cm2. Some manufacturers may advertise a higher MOI, but this is the result of using a heavier than desirable head weight.

Independent tests done by Golf Magazine for three years running using six to eight of the most popular putters, machine struck at a 12-foot flat distance, show the "falling off" line, when 0.75 inches miss-struck, to be from 6 to 10 inches. Similar "distance tests" were performed using the same clubs at a 16-foot distance. Here the "short fall" with a 0.75 inch mis-hit ranged from 10% to 14%. This extrapolates to 3% average (plus) per 0.25 inch and proportional to the MOI, as above. Accordingly, present putters are so similar in MOI that little, in any difference, in strokes saved is likely.

The typical professional golfer uses an average of 30 putts per 18 holes. The typical mid- to high-handicap player uses 38-40 putts per round. Certainly, most of the difference is due to practice, better ability to read the green, plus a more consistent stroke that allows the golfer to consistently strike the ball on the "sweet spot."

It is estimated that one-half of this 8-10 stroke difference is caused by mis-hitting the ball. Perhaps if a significantly higher MOI club could be developed, where striking the ball on the sweet spot was not so important, part of those 4-5 strokes could be saved.

Thus, what is desired is a means for putting a golf ball in repeatable manner, by providing a golf putter with a substantially higher MOI putter head.

SUMMARY OF THE INVENTION

The present invention is directed to a golf putter, more specifically a golf club comprising a frame or body fabricated of a metal and having a toe end cap and a heel end cap, the end caps being spaced apart one from the other by at least one rib or integral with the toe and heel end caps, the at least one rib and end caps partially defining at least central body void. An elongated central filler segment filling the central body void or chamber having a top surface and a bottom surface, and in the combination with the frame defining at least one generally or substantially vertically oriented planar ball contacting or striking face, wherein the central filler segment is fabricated of a polymer based material and further wherein the frame generating a moment of inertia significantly greater than a filler segment excluding the end caps.

One aspect of the present invention utilizes a body including a filler segment fabricated of a polymer based material such as an acrylic acetate having a marble like appearance.

Another aspect of the present invention utilizes a metal selected from a metal group consisting of brass, bronze, copper, stainless steel, steel, titanium, aluminum, and nickel for the fabrication of the body end caps or portions. The end caps or portions can be finished such as a nickel, silver, or gold plating, anodized, and the like for additional aesthetic appeal.

While another aspect assembles the body end cap to the filler segment utilizing an interface selected from an interface group consisting of dowel pins, tongue and groove, sliding dovetail joint, modified bridle joint, and a mortise and tenon. The dowel pins can be threaded, slotted, knurled, and the like to aid in mechanical retention.

In another aspect the golf club incorporates a ball strike portion ("ball strike"), preferably fabricated using a member having an annular ring shape such as a brass washer having a polymer-filled center, which is preferably an acrylic acetate, concentric with a "sweet spot" of the club head contact face.

Yet another aspect incorporates a laminate of acrylic assembled between the body end cap and the filler segment. The use of acrylic lends itself to the construction of a variety of combinations of colors and weights. The acrylic can include a variety of patterns further enhancing the aesthetics of the putter club. Additionally, the acrylic enables the putter club to easily be machined and/or sanded, then polished to reshape the head, customize (adding or reducing) the weight, and the like. This contrasts a metal putter club which is much more difficult to reshape and refinish.

And another aspect aligns a shaft with a center of the ball strike. It is preferred that shaft is located in the vertical centerline of the mass of the club. This configuration ensures the putter handle hangs vertically, making plumb bob break reading more accurate.

Wherein another aspect provides a second planar contacting surface located parallel to the first planar contacting surface. This configuration allows the player to use the putter as both a left handed and right handed player. By a change only in shafting the club.

An additional aspect of the present invention utilizes the higher Moment of Inertia (MOI) to stabilize the putter club. By incorporating a much denser material than the filler segment at each end of the filler segment an extremely high MOI is provided. More specifically and as emphasized throughout the more detailed description of the plurality of embodiments of the putter head, the predetermined weight of the body, including the filler segment, when used, and the dimension and configuration of said body are collectively determinative of a predetermined and preferred Moment Of Inertia (MOI) of said body. The structuring of the putter head to demonstrate a significantly greater MOI (generally about 10,000 gram/cm2 to 13,000 gram/cm2) contrasts with the currently used means of adding weight to the back of the putter head as in the mallet design to increase the MOI. The additional weight only marginally reduces the feel or touch for distance. An undesirable result with the present shape and size of current putters in the range of twelve ounces, which makes head weight comparable to the head weight of better putters.

Another aspect or feature is that the design utilizes a straight shaft attached to the symmetrically balanced head, which allows the shaft to be used in a manner similar to a plumb bob for accurate and easy reading of the expected break (or side movement) in the course or the ball due to gravity. Working off a known vertical to estimate the break or course of travel is more accurate than the horizontal plane that depends upon a golfer's sense of balance, which varies with age, vision and health. The vertical plumb bob technique or method of reading produces a specific target point to aim at or above, where working off the horizontal does not.

With another aspect includes the structuring of the putter club head to be longer, such as 6" to 7". A larger putter head allows or makes possible easier alignment of the club with the target. This compares to conventional putters, which incorporate a front putter club head length of 4" to 4.5".

While another aspect provides contact surfaces that are angled, providing lift to the golf balls when struck.

Whereas another aspect incorporates putter centerline references across the top surface of the putter club, allowing the player to reference the "sweet spot" from the top of the club.

With another aspect providing a central contact surface plate along a central position of at least one of the contacting surfaces of the putter club.

Yet another aspect utilizes a putter club having a rounded toe and heel, such that the player can only use one of the two playing surfaces for contacting the golf ball, as directed by the United States Golf Association (USGA) guidelines.

Another aspect provides left and right ribs or side segments extending between and interconnecting to the toe and heel to define the void for the polymer based filler segment.

A further aspect provides a vertical support rib extending between the left and right ribs and in registration with a center of mass.

And yet another aspect provides a horizontal support rib extending between the left and right ribs and in registration with a center of mass.

The present invention comprises yet additional preferred embodiments of the golf putter head including a body having a substantially integral construction. More specifically, the body includes oppositely disposed end portions or end caps located at and at least partially defining the toe end and the heel end of the body. Each of these opposite end portions are interconnected by integrally formed side segments disposed in spaced relation to one another. Each of the side segments includes an outer side surface such that at least one of the side segments include a ball striking face of the body and putter head. As will be explained in greater detail hereinafter, the versatility of the putter head may be increased by structuring and/or configuring each of the exterior surfaces of each of the two side segments to define oppositely disposed striking faces. As such, the golf putter incorporating the putting head as set forth therein may be used by right handed or left handed golfers.

In addition, the head includes a substantially centrally disposed chamber extending along a predetermined length and preferably at least a majority of the length of the body. The lower end of the chamber may, in certain embodiments be left open. However, in other preferred embodiments the body includes a floor disposed in covering, closing relation to a corresponding end of the chamber such that the floor is integrally secured to the remainder of the body including the two side segments and the opposite end portions. As a result, the exterior surface of the floor defines a bottom end or exterior surface of the putter head and/or body along with corresponding surfaces of the end portions.

The chamber is further formed and structured to at least initially or originally include an open or upper top end which may be disposed in aligned relation to the upper or top surface of the body of the putter head. In an additional preferred embodiment of the present invention, the body further includes a filler segment sufficiently configured and dimensioned to fill the centrally disposed chamber of the body such that substantially the entire interior of the chamber is filled with the filler segment and the initially open upper end of the chamber is closed or covered by the filler segment. As such, the filler segment is preferably disposed in aligned substantially coplanar relation to the upper or top surface of the body of the putter head. It is emphasized that the putter head as defined in different embodiments of the present invention may be structured to include the filler segment within the chamber or alternately, leave the chamber open and/or absent the filler segment. However, as also set forth herein, in certain embodiments the inclusion of the polymer material filler segment within the chamber increase the stability, strength and/or durability of the butter head.

As also set forth in greater detail hereinafter the structuring of the body of the putter head is such as to define a predetermined moment of inertia (MOI) thereby facilitating a smoother, reliable, more accurate stroke of the putter head when utilized. The MOI in turn is at least partially dependant on the weight of the material from which the body is formed and as such the body is preferably formed of a metallic material of a predetermined weight. The metallic material from which the body is formed may differ and may include aluminum, stainless steel, bronze and/or a variety of other metals. The overall weigh of the head, as at least partially defined above, is preferably between 10 ounces and 12 ounces and in at least one preferred embodiment generally about 11 ounces. Concurrently, the length of the body of the putter head should comply with USGA rules and regulations. Accordingly the length of the body of the putter head is generally about 6" and may be generally about 7", as set forth in greater detail hereinafter.

In maintaining the intended and preferred weight parameters of the body of the putter head, including the weight of the filler segment when included, the dimension and/or configuration of the body may vary but preferably is within the dimensional parameters of 6" or 7". Accordingly, the structuring of the putter head to be within both the above set forth weight and dimensional parameters, while demonstrating a significant increase in MOI over conventional putter heads, such as in the range of 10,000 grams/cm2 to 13,000 grams/cm2, is dependent on the weight of the metal or other material from which the body of the head is formed and the cooperative adaptation of the configuration of the putter head body needed to achieve the preferred higher range of MOI, as set forth above.

Also, the heavier the material from which the body of the putter head is formed the dimension and/or configuration of the chamber may be at least partially increased and the size and/or configuration of the at least some of the remaining body portions may be at least partially decreased, to accommodate the heavier body. In the alternative, the lesser the weight of the metallic material from which the body of the putter head is formed, the smaller the dimension and/or configuration of the chamber and an at least partial increase in the other body portions. As a result, varying weight, dimension and/or configuration of the body, including the chamber, will be at least partially determinative of the MOI. Such physical variance will be dependent on the preferred and intended parameters of the body of the putter head being between 10 and 12 ounces and in a preferred embodiment generally about 11 ounces and the MOI being 10,000 grams/cm2 to 13,000 grams/cm2. However, one feature common to both the heavier and lighter putter bodies is the concentration of at least most of the gross weight of the body in the end portions, such as in the toe and heel end portions.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
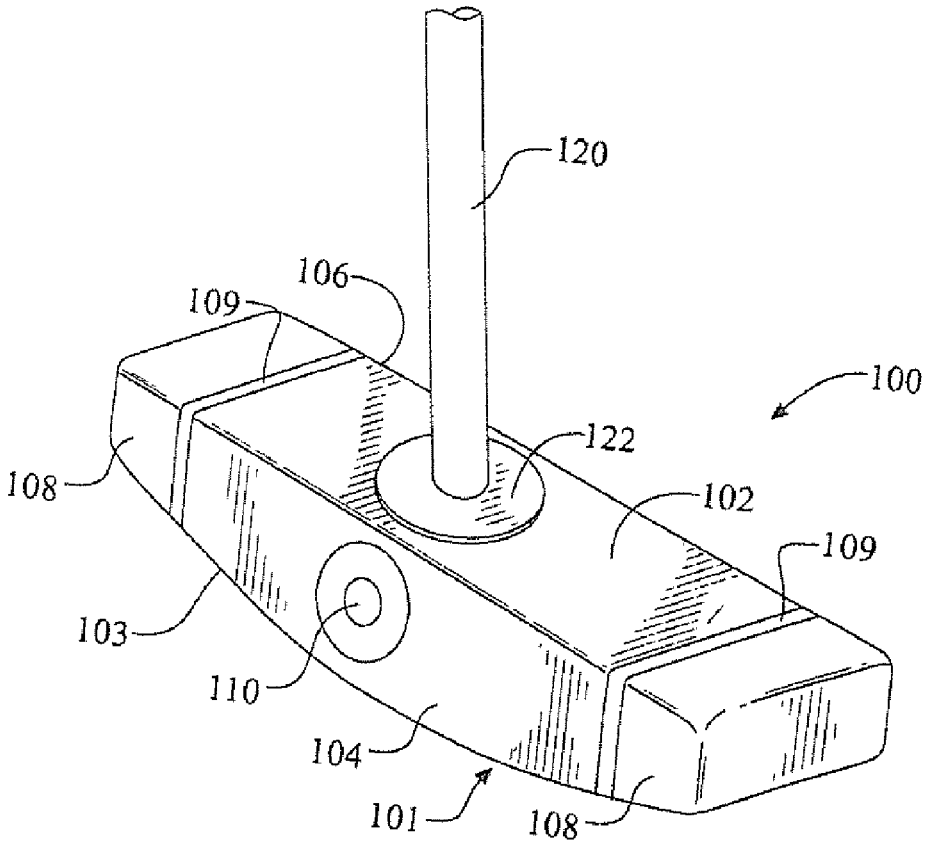
FIG. 1 illustrates an isometric view presenting a golf putter in accordance with an exemplary embodiment of the present invention.
Figure 2:
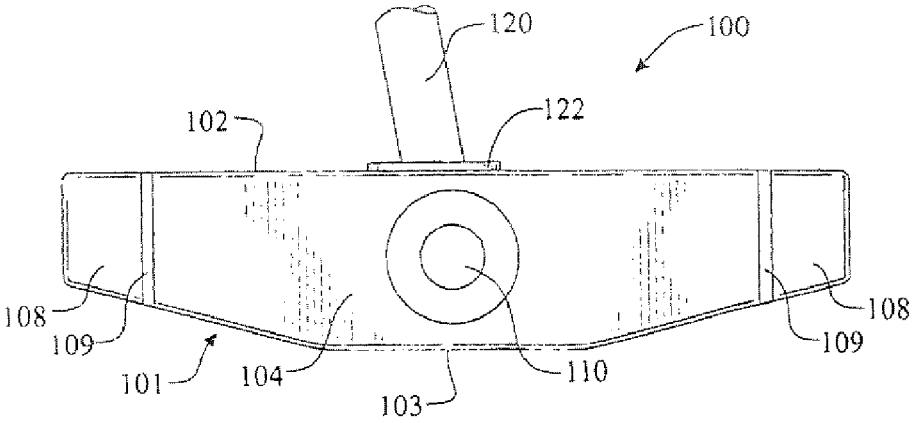
FIG. 2 illustrates an elevation view of a left hand contacting face of the golf putter originally illustrated in FIG. 1.
Figure 3:
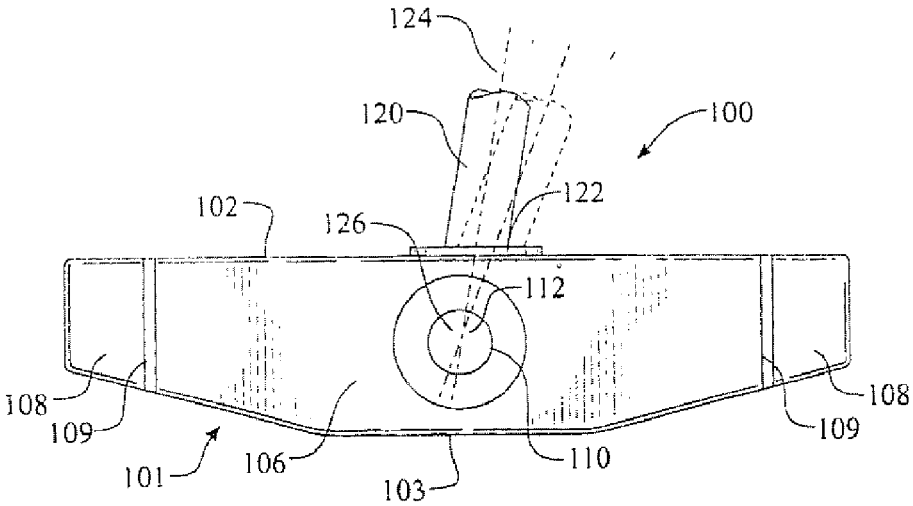
FIG. 3 illustrates an elevation view of a right hand contacting face of the golf putter originally illustrated in FIG. 1.
Figure 4:
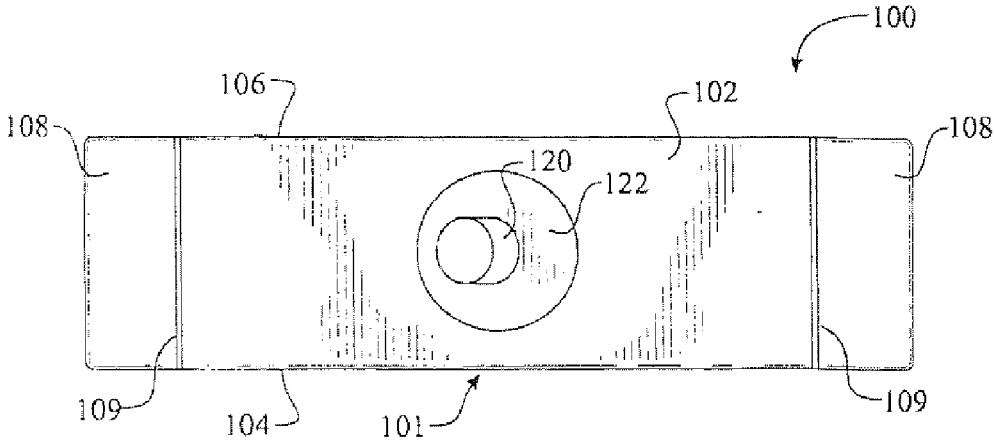
FIG. 4 illustrates a planar top view of the golf putter originally illustrated in FIG. 1.
Figure 5:
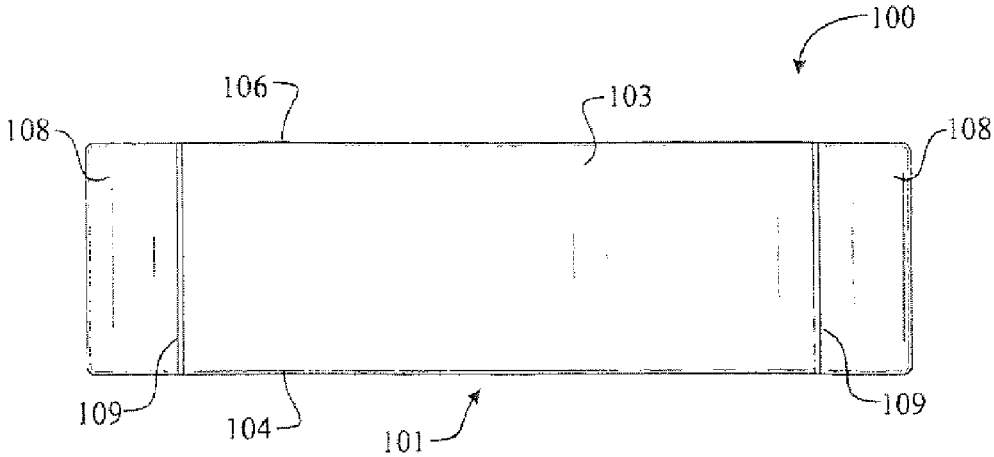
FIG. 5 illustrates a planar bottom view of the golf putter originally illustrated in FIG. 1.
Figure 6:
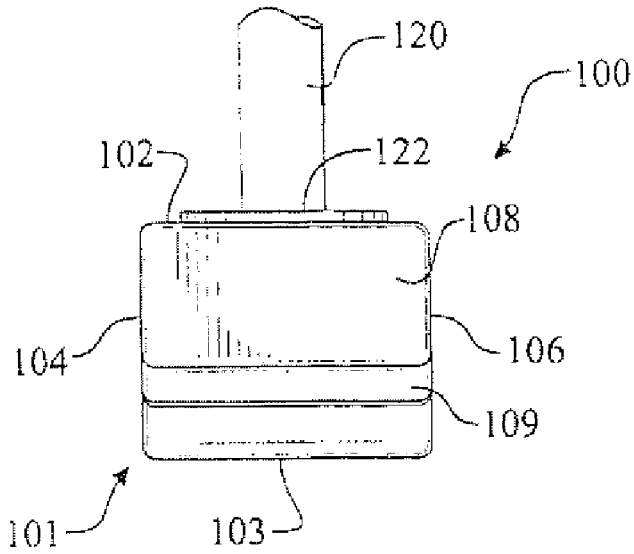
FIG. 6 illustrates an elevation view of a toe end of the golf putter originally illustrated in FIG. 1.
Figure 7:
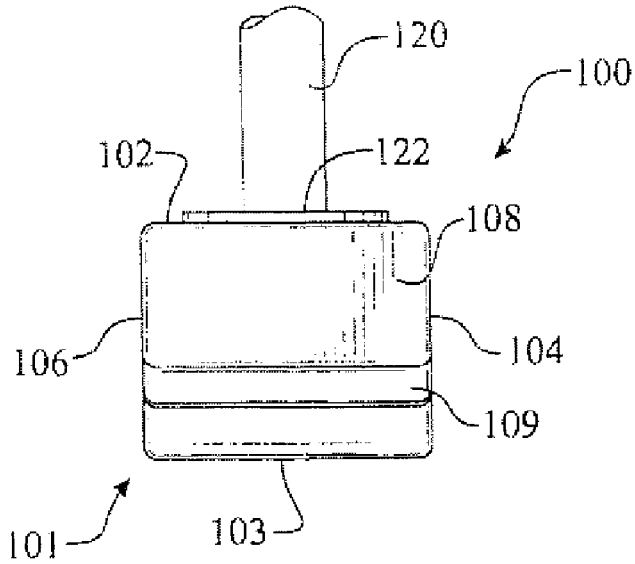
FIG. 7 illustrates an elevation view of a heel end of the golf putter originally illustrated in FIG. 1.

For purposes of description herein, the terms "upper', "lower", "left", "rear", "right", "front", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characterizes relating to the embodiments disclosed herein are not to be considered as limiting, unless the claims expressly state otherwise.

Turning to the drawings, FIGS. 1 through 12 present various views of an exemplary embodiment of the present invention referred to as a putter assembly 100. The putter assembly 100 comprises a putter club assembled to a shaft 120 via a shaft ferrule 122. The putter club is fabricated having a putter man body 101 and a pair of body end caps 108; one end cap 108 being assembled to each end of the putter main body 101. An optional contrasting laminate 109 can be laminated between the body end cap 108 and the putter main body 101. An optional ball strike 110 can be assembled to the putter main body 101 aligned to what is commonly referred to as the "sweet spot." The "sweet spot" is horizontally located equidistant between the two body end caps 108 and at a desired vertical location. The shaft 120 has a shaft centerline 124, which aligns through a strike centroid 126 of the ball strike 110 (or representative location). The ball strike 110 can include an optional ball strike center reference 112 located centered within the ball strike 110, further aiding in identifying the optimal ball contact location.

Figure 8:
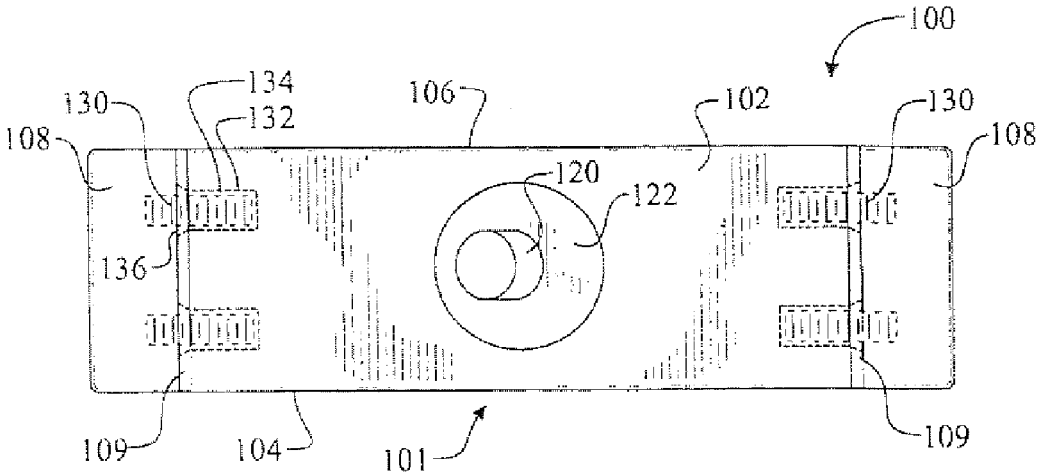
FIG. 8 illustrates a planar top view of the golf putter originally illustrated in FIG. 1, introducing one exemplary means for assembling a body end cap to a putter body.
Figure 9:
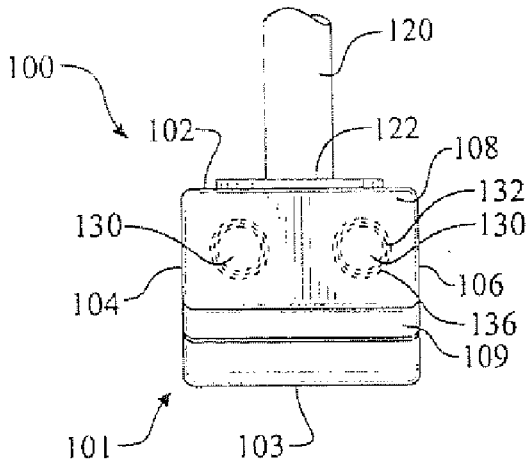
FIG. 9 illustrates an elevation end view of the golf putter as previously illustrated in FIG. 8.
Figure 12:
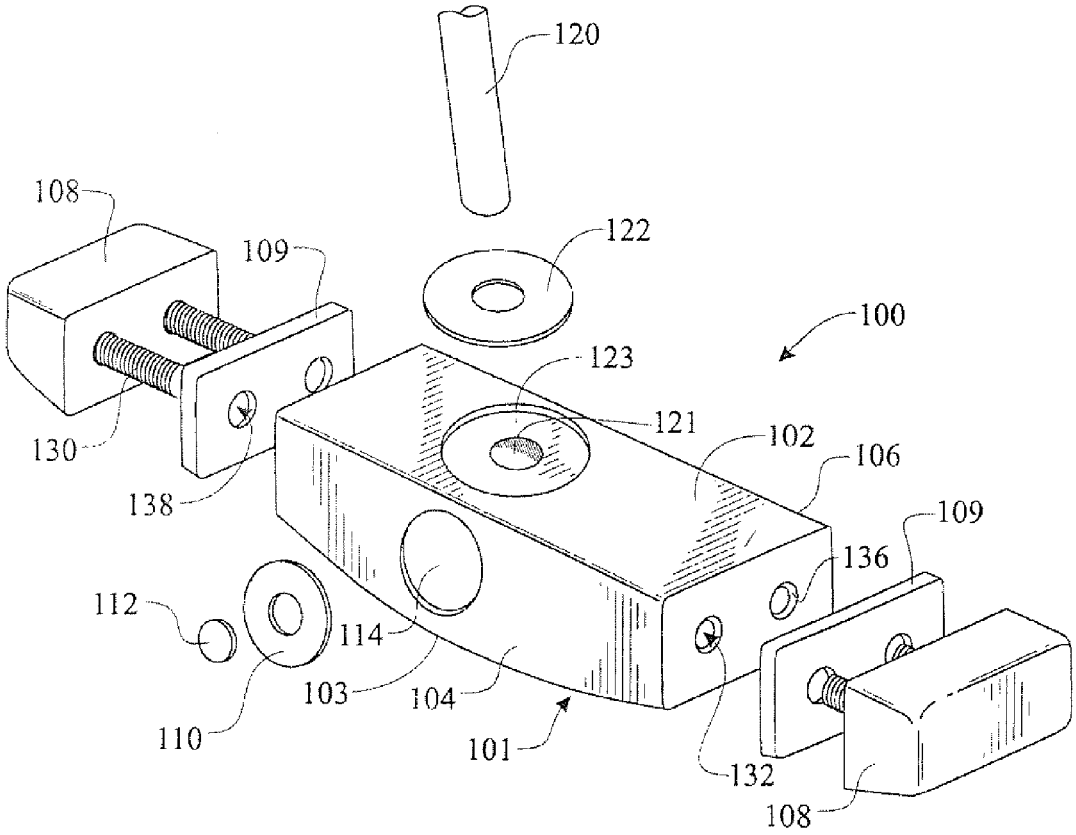
FIG. 12 illustrates an exploded isometric assembly view of the golf putter in accordance with an exemplary embodiment of the present invention.

The putter main body 101 is fabricated of a polymer, such as an acrylic base material. The acrylic is preferably of a marble-like appearance and can be of a single stock or laminated stock to obtain the required dimensions. The putter main body 101 would be roughly shaped slightly larger than the desired finished geometry. The ends of the putter main body 101 are machined to a planar surface for assembly of the body end caps 108. The body end caps 108 are fabricated from any reasonable metal or similar material having a weight and hardness that is desired. A pair of body end caps 108 are formed via any known process, including casting, machining, extruding, and the like, selected based upon the respective material chosen. A body end cap 108 is assembled to each end of the putter main body 101 via any desired joining interface, including a butt joint, utilizing at least one (preferably a pair) threaded dowels 130 as illustrated in FIGS. 8, 9, and 12. Each threaded dowel 130 can be partially inserted into a threaded receptacle of body end cap 108. The exposed portion of the threaded dowel 130 is inserted into a fastener receptacle 132 machined into the putter main body 101. The fabricated sample putter clubs utilized threaded dowels 130 having a ¼ inch diameter and 1 inch in length being inserted into a ⅜ inch diameter fastener receptacle 132. A flared lead in 136 can be machined into the putter main body 101, providing a guide for insertion of the threaded dowels 130 into the fastener receptacles 132. The threaded dowels 130 are assembled to the putter main body 101 via an epoxy 134. The epoxy is preferably a two-part mix, but can be any known composition. A pair of laminate apertures 138 (FIG. 12) is formed through the contrasting laminate 109, providing clearance for the threaded dowels 130. It is understood that any elongated reinforcing member can be used for the threaded dowels 130, including nylon screw studs. The joining interface can be provided via any known joining design, including, a tongue and groove, a sliding dovetail joint, a modified bridle joint, a mortise and tenon, and the like to ensure reliability. A thin layer of acrylic of a contrasting color can be provided forming an optional contrasting laminate 109. The contrasting laminate 109 would be laminated between each body end cap 108 and the end of the putter main body 101. The adhering surfaces of the body end caps 108 can be roughened by any machining process, such as by sanding with a rough grit to create a cross hatched surface. The interface design would be carried through and incorporated within the contrasting laminate 109 as required. The ball strike 110 (having a ball strike center reference 112) is inserted into a drilled or machined recession within a planar contacting face of the putter main body 101. The various components are assembled using an adhesive or joint compound that is compatible with each of the materials as well as the ability to withstand the shock incurred during use. Once such exemplary joining material is a two-part epoxy.

When the adhesive (such as an epoxy) is properly cured, the completed putter head is shaped into the final geometry using any known shaping means, such as a belt sander, a milling machine, and the like. The finished head provides a putter top surface 102 that is preferably planar, a left handed planar putting surface 104 and a right handed planar putting surface 106 (parallel to the left handed planar putting surface 104), and a putter bottom surface 103. The putter bottom surface 103 is shaped having a convex or convex-like elevation shape, providing a central portion that has a larger height compared to each of the two ends. The edges are then chamfered or rounded using the appropriate machines, such as a disc sander, belt sander, small router, and the like. The assembly can be polished to the desired finish, such as a high luster, a matt luster, or a sanded finish. The shaft 120 is assembled to the putter top surface 102, passing through the shaft ferrule 122, and into a hole drilled into the body 101. The shaft 120 is then secured into the hold with an epoxy.

Figure 10:
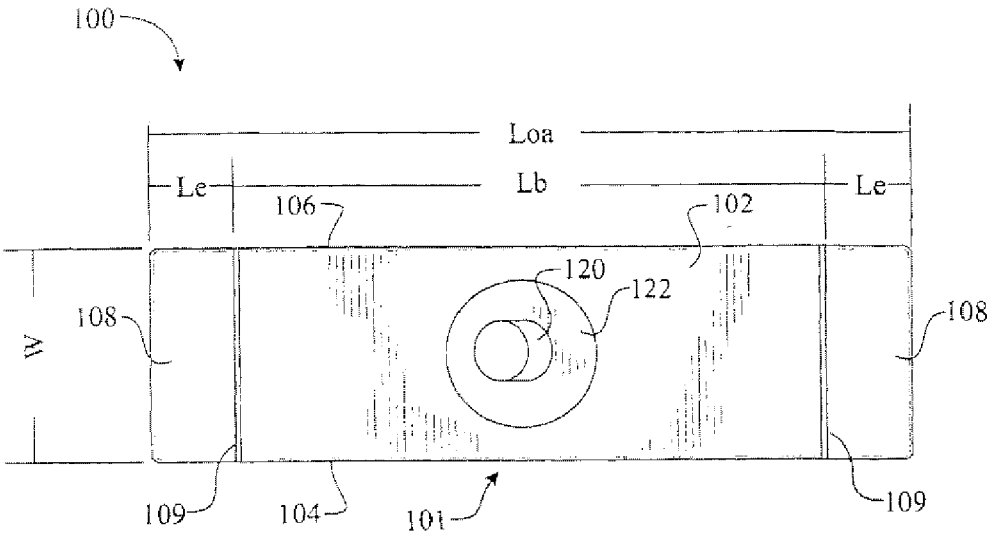
FIG. 10 illustrates a planar top view of the golf putter originally illustrated in FIG. 1, providing several dimensions.
Figure 11:
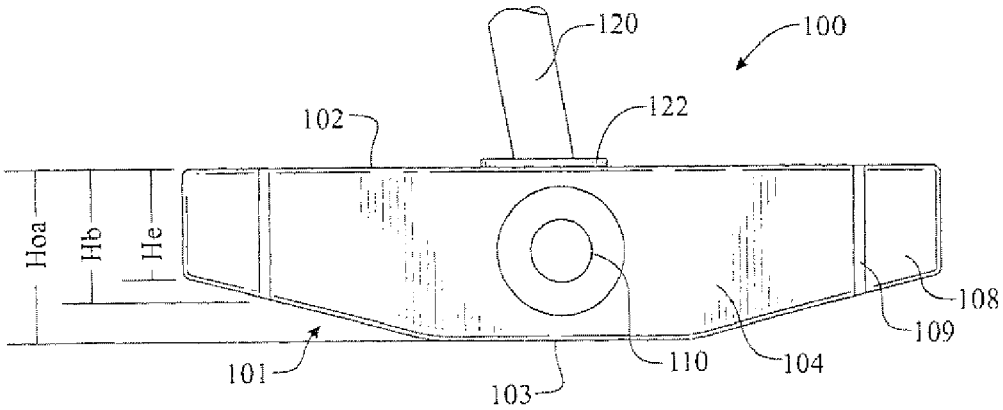
FIG. 11 illustrates an elevation view of a left hand contacting face of the golf putter originally illustrated in FIG. 1, providing several dimensions.

The general dimensions of at least one embodiment of the putter club are presented in FIGS. 10 and 11. The dimensions are preferably in accordance with the golf association standards, such as the United States Golf Association (USGA). The putter head would have an overall dimensions defined via an overall length L, and an overall width W. The overall length L is preferably between 5½" and 7", with a target or face length being at least 4". Each body end cap 108 would have an end length L of ⅝ to 1". The outer end of the body end cap 108 would have a dimension referenced as an end height He being approximately ⅞". The edge of the assembly can be machined to provide a ½" radius. The joining end of the body end cap 108 would have a dimension referenced as a joining body height Hb being approximately 1" at the connection point. The maximum height of the putter main body 101 would have a dimension referenced as an overall height Hoa being approximately 1¼". It is recognized the dimensions may vary, with the presented dimensions being provided for the exemplary embodiment presented herein. The shape can be used for adjusting the weight of the head. The desired weight of the putter head is between 10 and 12 ounces. When the standard tapered steel shaft and rubber grip is added the total putter weight is very close to 18 ounces.

The shape of the putter assembly 100 illustrated presents a vertical contact face 104, 106. Alternate embodiments can be designed utilizing a lofting face, or one that is angled such to lift the ball when struck.

The putter club provides a lightweight central body 101 having a heavier body end caps 108 disposed upon each end. The central body 101 is preferred to have a weight of four to five ounces. The end caps 108 would have a preferable weight of six (6) to seven (7) ounces. This configuration provides a higher Moment of Inertia (MOI), which reduces the potential of rotation of the club head during a swing when mis-hit. The weight and MOI can be tailored by selection of materials, removing some material from the interior of the central body or chamber 101 and/or the end caps 108, modifying the shape of the club, and the like including adding weight to the inside of the shaft.

The shape of the putter can be varied as shown in a second exemplary embodiment referred to as a putter assembly 200 and illustrated in FIGS. 13 through 18. The putter assembly 200 comprises a putter club head assembled to a shaft 220 by inserting an assembly end of the shaft 220 into a shaft receiving hole 221. A shaft ferrule 222 can be assembled about the shaft 220 providing aesthetics, stability, and reliability to the assembly. The shaft ferrule 222 can be assembled upon a putter top surface 202 of the putter main body 201, or within a recess (similar to shaft receiving hole 121 of FIG. 12).

The putter club is fabricated having a putter main body 201 and a pair of body end caps 208 assembled to each end of the putter main body 201. The putter main body 201 is defined having a putter top surface 202, a putter bottom surface 203, a left handed planar putting surface 204, and a right handed planar putting surface 206. The putter main body 201 is preferably fabricated of an acrylic acetate material, but can be fabricated of any reasonable lightweight, durable material. In the exemplary embodiment, a marbled acrylic material is used, providing an aesthetically pleasing putter fiber. Glass strands may be added to the basic acrylic mixture to increase the strength of the material.

An optional contrasting laminate 209 can be laminated between the body end cap 208 and the putter main body 201. In the exemplary embodiment, the contrasting laminate 209 is fabricated of a solid colored acrylic sheet. The contrasting laminate 209 is glued to the end of the putter main body 201 using commonly known adhesives for bonding acrylics.

An optional ball strike 210 can be assembled to the putter main body 201 aligned to what is commonly referred to as the "sweet spot" as previously disclosed. The sweet spot is located by a line axis through the center of mass and intersecting the club face when the club face is perpendicular to the target. The ball strike 210 can include an optional ball strike center reference 212 located centered within the ball strike 210, further aiding in identifying the optimal ball contact location. A central contact surface plate 216 can be assembled to the putter main body 201, providing a harder surface for ball impact compared to the putter main body 201. The central contact surface plate 216 is fabricated of a metal or other dense material. The central contact surface plate 216 can be inserted into a strike plate recess 217, forming a flush surface along each of the left handed planar putting surface 204 and right handed planar putting surface 206. The ball strike 210 can optionally include a logo, a design, be of a coin, a washer, or other stamped object, and the like. A series of putter centerline reference 218 can be provided within the putter top surface 202 providing identification of the "sweet spot" from the top of the putter. The advantage of this alternate metal face insert is to provide a more familiar sound to the player, plus providing a faster ball reaction off the face. Reduced end weighting corrects to weight so added. It is understood the putter assembly 200 can include one or more of the putter centerline references 218. The centerline references 218 can be a rifle site marking, either recessed or imprinted.

Figure 16:
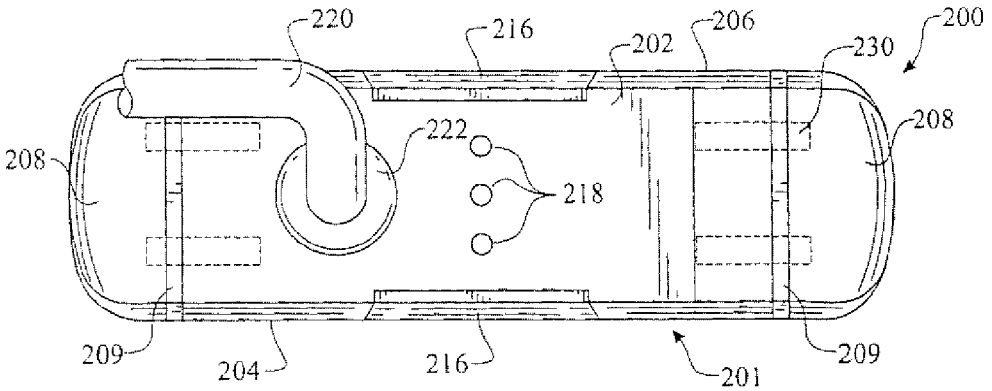
FIG. 16 illustrates a planar top view of the golf putter originally illustrated in FIG. 13.
Figure 17:
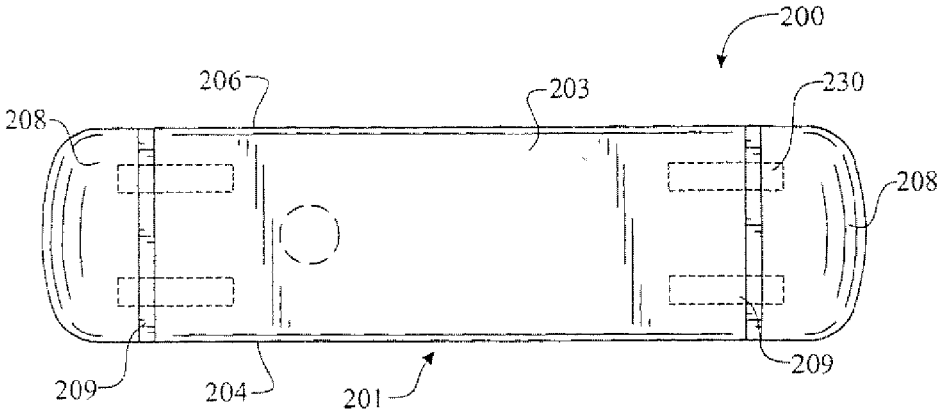
FIG. 17 illustrates a planar bottom view of the golf putter originally illustrated in FIG. 13.
Figure 18:
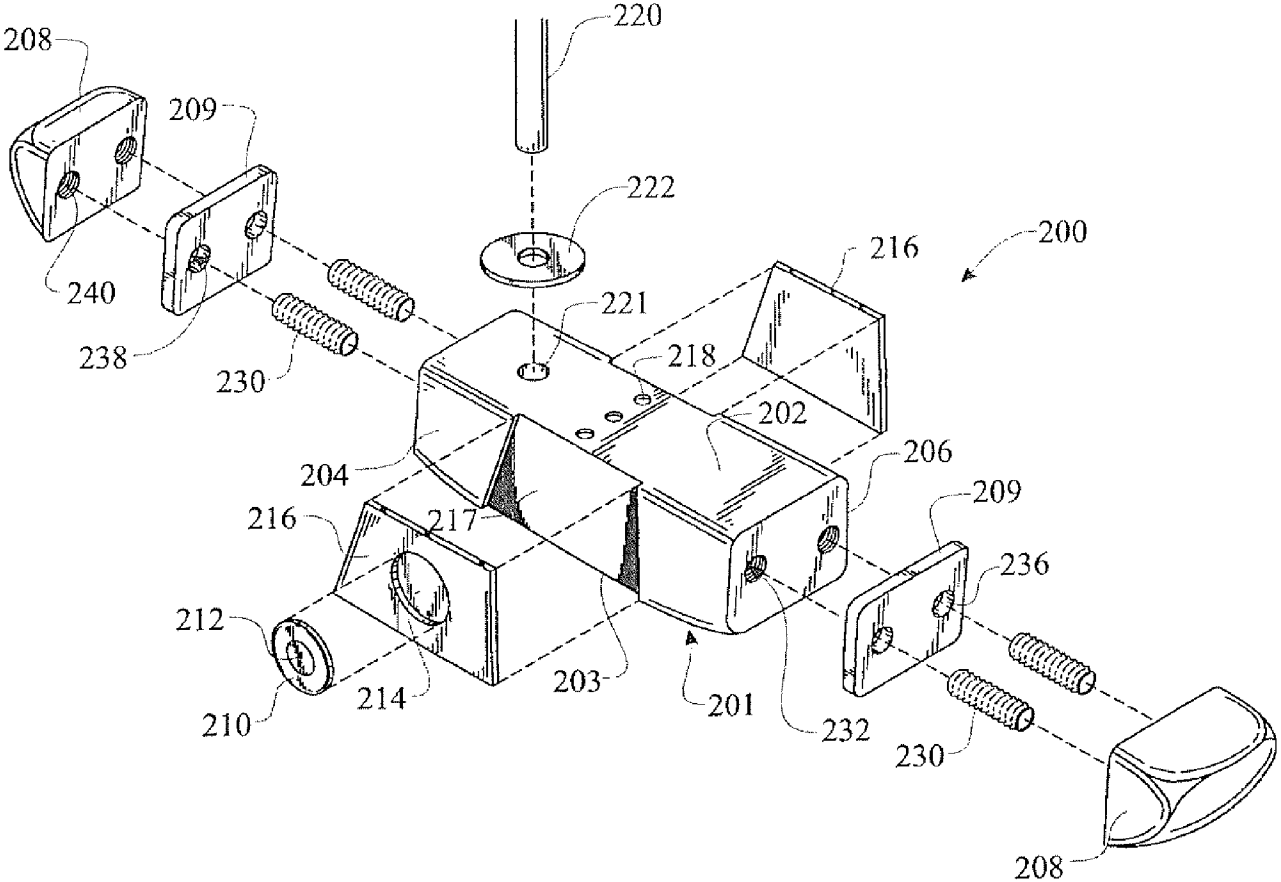
FIG. 18 illustrates an exploded isometric assembly view of the golf putter in accordance with the second exemplary embodiment of the present invention.
Figure 19:
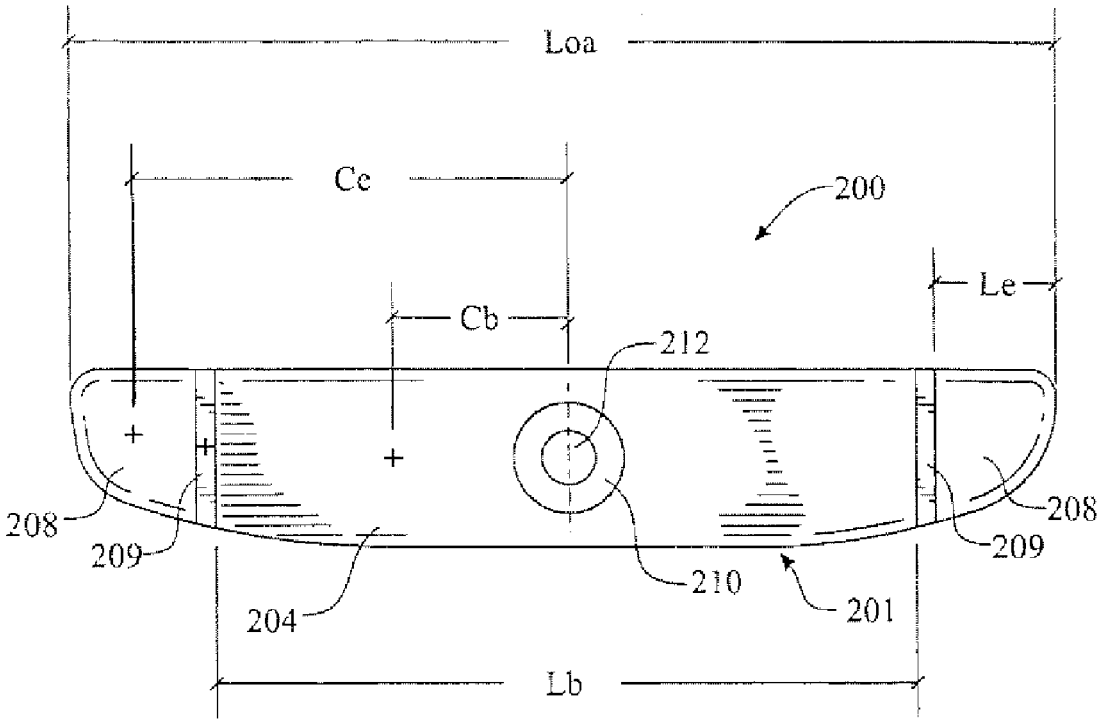
FIG. 19 illustrates the calculation of a Moment of Inertia (MOI) utilizing the second exemplary embodiment of the present invention as a reference.

The fabrication of the putter club initiates by roughly shaping the putter main body 201 into a shape and size slightly larger than the desired finished geometry. The ends of the putter main body 201 are machined to a planar, preferably parallel, surface for assembly of the body end caps 208. The body end caps 208 are fabricated from any reasonable metal or similar material having a density, weight and hardness that are desired. The preferable material can be Brass, Bronze, Stainless Steel, and the like. A pair of body end caps 208 are formed via any known process, including casting, machining, extruding, and the like, selected based upon the respective material chosen. One body end cap 208 is assembled to each end of the putter main body 201 via any desired joining interface, including a butt joint. The joint can be reinforced with the inclusion of at least one (preferably a pair) threaded dowel 230 as illustrated in FIGS. 16, 17, and 18. Each threaded dowel 230 can be partially inserted into a threaded receptacle 232 of body end cap 208. The exposed portion of the threaded dowel 230 is inserted into a fastener receptacle 232 machined into the putter main body 201. The prototype putter clubs fabricated utilized threaded dowels 230 having a ¼ inch diameter and 1 inch in length being inserted into a ⅜ to ½ inch diameter fastener receptacle 232. A flared lead in 236 can be drilled into the putter main body 201, providing a guide for insertion of the threaded dowels 230 into the fastener receptacles 232. The threaded dowels 230 are assembled to the putter main body 201 via an epoxy. A pair of laminate apertures 238 (FIG. 12) is formed through the contrasting laminate 209, providing clearance for the threaded dowels 230. Alternately, the joining interface can be provided via any known joining design, including, a tongue and groove, a sliding dovetail joint, a modified bridle joint, a mortise and tenon, and the like. A layer of acrylic of a complimentary or contrasting color can be provided forming an optional contrasting laminate 209. The contrasting laminate 209 would be laminated between the body end cap 208 and the end of the putter main body 201. The interface design could be carried through and incorporated within the contrasting laminate 209 as required. The ball strike 210 (having a ball strike center reference 212) is inserted into a drilled or machined recession within a planar contacting face of the putter main body 201. The various components are assembled using an epoxy, adhesive, or other joint compound that is compatible with each of the materials as well as the ability to withstand the shock incurred during use. Glass or other fibers can be mixed into the epoxy, strengthening the joints.

When the adhesive (such as an epoxy) is properly cured, the completed putter head is shaped into the final geometry using any known means, such as a belt sander, a milling machine, and the like. The finished head provides a putter top surface 202 that is preferably planar, a left handed planar putting surface 204 and a right handed planar putting surface 206, and a putter bottom surface 203. The putter bottom surface 203 is shaped having a convex or convex-like elevation shape, providing a central portion that has a larger height compared to each of the two ends. The bottom edge preferably is flat along approximately ⅔ of the overall length of the putter club. The ends of the putter club, primarily the body end cap 208 and proximate region of the club are rounded to meet the requirements of the USGA. The edges are then chamfered or rounded using the appropriate machines. The ends may be convex or concave as long as they do not constitute a reasonable hitting surface.

Figure 15:
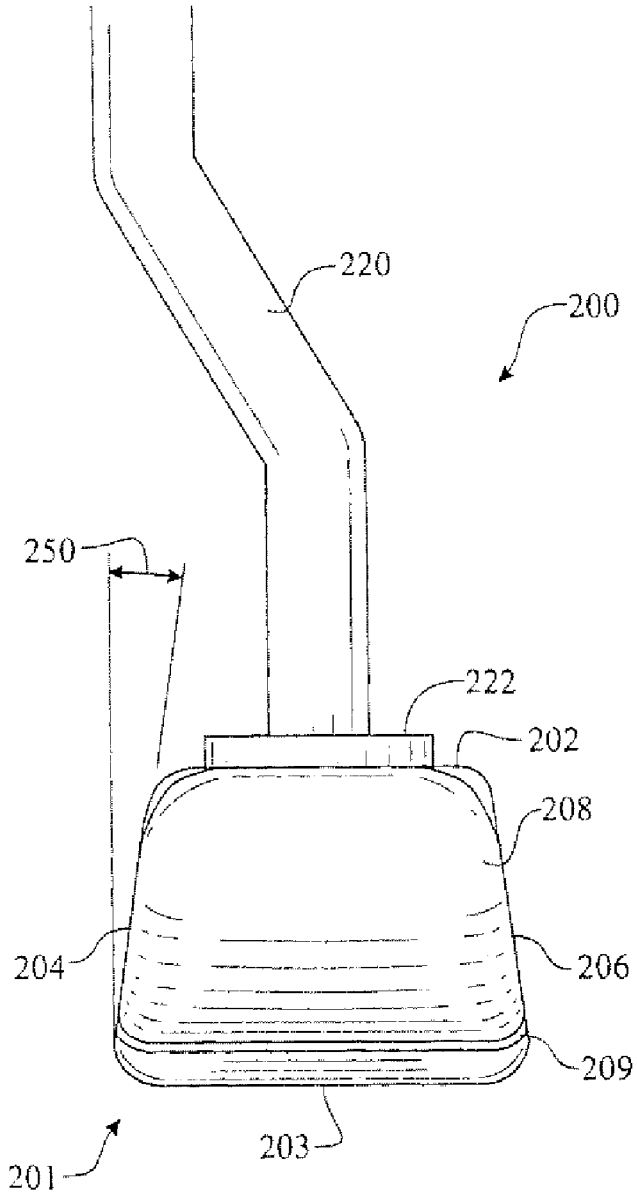
FIG. 15 illustrates an elevation view of a toe end of the golf putter originally illustrated in FIG. 13.

The two sides 204, 206 can be angled providing a loft as illustrated via angle 250 of FIG. 15. The preferred angle would be 5 degrees. The end profile view (FIG. 15) best illustrates a putter club having a putter bottom surface 203 that is wider than the putter top surface 202. The lower and upper edges can be rounded, chamfered or any other edge finish that meets USGA guidelines. The ball contact face may be rougher than a medium sand blasted texture so as not to impart a spin to the call other than by normal friction. Decorative grooves can be formed thereon adhering to USGA standards.

Identifiers and other finishing elements, such as the ball strike 210, putter centerline reference 218, and optional contact surface plate 216, are assembled using an appropriate joining medium. The various finishing elements must not be loose or hollowed behind them. Since the assembly location of at least a portion of the components is critical, the locations are determined after the putter club is shaped. The ball strike receiving cavity 214 is machined into either the putter main body 201 or the central contact surface plate 216, based upon the desired design. Where an optional central contact surface plate 216 is included, the strike plate recess 217 is machined into the left handed planar putting surface 204 and right handed planar putting surface 206 of the putter main body 201. The central contact surface plate 216 is inserted into the strike plate recess 217 and secured via a full filled waterproof bonding agent. The ball strike 210 is inserted into the ball strike receiving cavity 214 of the central contact surface plate 216 and secured via a bonding agent. The series of putter centerline references 218 are assembled by forming a hole for each of the putter centerline reference 218. The putter centerline reference 218 is inserted into the hole, leaving a small portion proud of the putter top surface 202. The completed putter club is machined, smoothing all surfaces.

The assembly can be final shaped and polished to the desired finish, such as a high luster, a matt luster, or a sanded finish. The shaft 220 is assembled to the putter top surface 202, passing through the shaft ferrule 222, and into the shaft receiving hole 221 of the body 201. The shaft 220 is then secured into the hole with an epoxy. The shaft receiving hold 221 can be located centered or offset along the longitudinal axis of the putter top surface 202 based upon the selected shaft 220. This promotes a proper straight back and through stroke, preferred by most golfers.

Although the putter main body 101, 201 is presented as having two planar contacting surfaces, it is recognized that the putter can be formed having only one planar contacting surface and any variety of shapes formed on the opposing side. This would define the putter as a single-handed design. The acrylic putter head samples provided are of a variety of colors (or clear), including (but not limited to) blue, green, black, purple, pink, white, yellow, and red. The acrylic includes a marbling appearance providing a very unique appearance to the club. The body 101, 201 can be fabricated via laminating a plurality of acrylic pieces into a design. The acrylic pieces can be of different colors and the lamination can be random or patterned, such as cross banding, lengthwise, checkered, and the like. The welding of the pieces using the solvent actually increases the strength of the body 101, 201. The body end cap 108 is provided in solid brass. The ball strike 110 is provided in solid brass. The ball strike center reference 112 is of a hard red acrylic material. The optional contrasting laminate 109 is provided in any available colors of acrylic. The various colors, textures, grains, and other appearances of the materials allows for distinctive personalized choices.

The putter club can be further modified with several optional design features. The putter club 100, 200 can be fabricated including a metal bottom surface 103, 203. The bottom surface 103, 203 can include a convex curvature arranged along a longitudinal axis of the putter main body 101, 201 (which will be detailed in the illustration of FIG. 21) or applied flat with tapered ends matching the end curvature. The MOI gains from this application verses the "at center" metal face insert. Though the mostly decorative, every change or alternate affects the MOI.

As set forth above, the MOI is calculated by multiplying the total weight of the body of the putter head, in grams, by the distance squared between the "sweet spot" on the face and the center or mass point of the body head, wherein the MOI presented in grams/cm2. However, for purposes of accuracy and clarity the calculation of the MOI of the body of the putter head in each of the preferred embodiments may be accomplished by determining the MOI of the various components of the body, such as the end portions, side segments and other portions of the body and then adding these independently obtained MOI's to obtain a final MOI of the body of the putter head.

Figure 20:
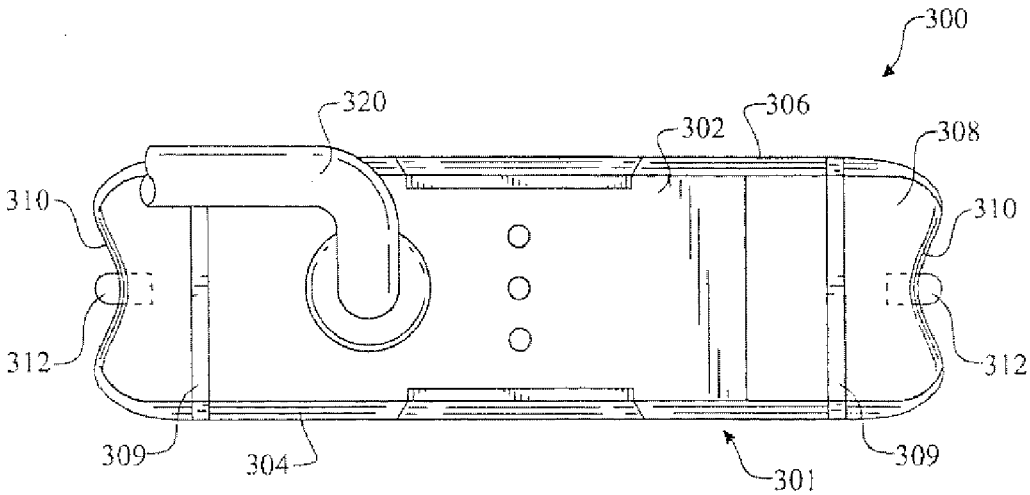
FIG. 20 illustrates a golf putter club in accordance with the present invention having a modified toe and heel shape.
Figure 21:
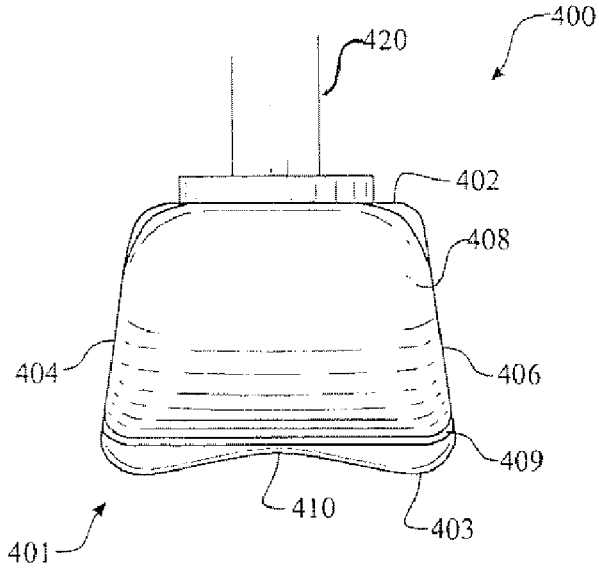
FIG. 21 illustrates a golf putter club in accordance with the present invention having a concave lower surface.

Optional features are presented in two exemplary embodiments, a putter assembly 300 illustrated in FIG. 20 and a putter assembly 400 illustrated in FIG. 21. The putter assembly 300 is formed including the same general components as the putter assembly 100, 200, providing a putter assembly 300 assembled to a club end of a shaft 320. The putter assembly 300 comprises a body end cap 308 assembled at each end of the putter main body 301. The putter main body 301 is defined having a putter top surface 302, a left handed planar putting surface 304, a right handed planar putting surface 306, and a bottom surface (understood, but not referenced). A contrasting laminate 309 can be laminated between each of the body end caps 308 and the putter main body 301. The body end caps 308 can be shaped to include a concave end surface 310.

The putter assembly 400 is formed including the same general components as the putter assemblies 100, 200, 300, providing a putter assembly 400 assembled to a club end of a shaft 420. The putter assembly 400 comprises a body end cap 408 assembled at each end of the putter main body 401. The putter main body 401 is defined having a putter top surface 402, a putter bottom surface 403, a left handed planar putting surface 404, and a right handed planar putting surface 406. A contrasting laminate 409 can be laminated between each of the body end cap 408 and the putter main body 401. The putter main body 401 can be shaped to include a concave bottom surface 410.

Figure 13:
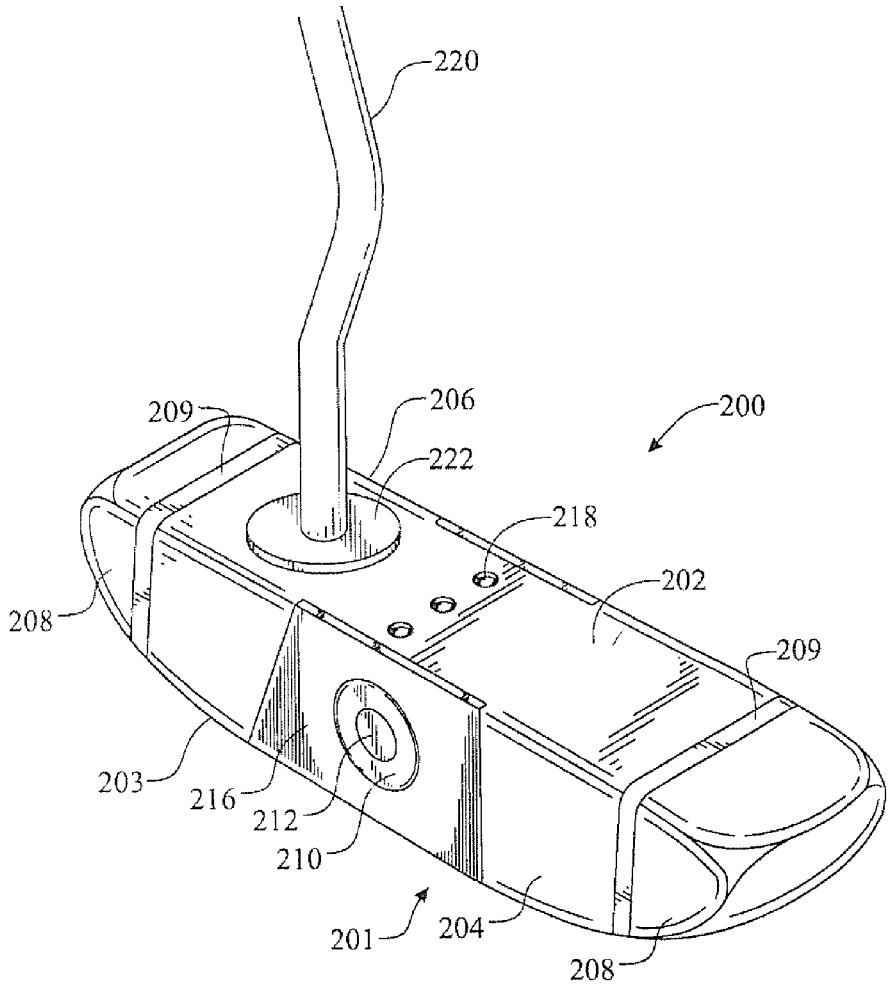
FIG. 13 illustrates an isometric view presenting a golf putter in accordance with a second exemplary embodiment of the present invention.
Figure 14:
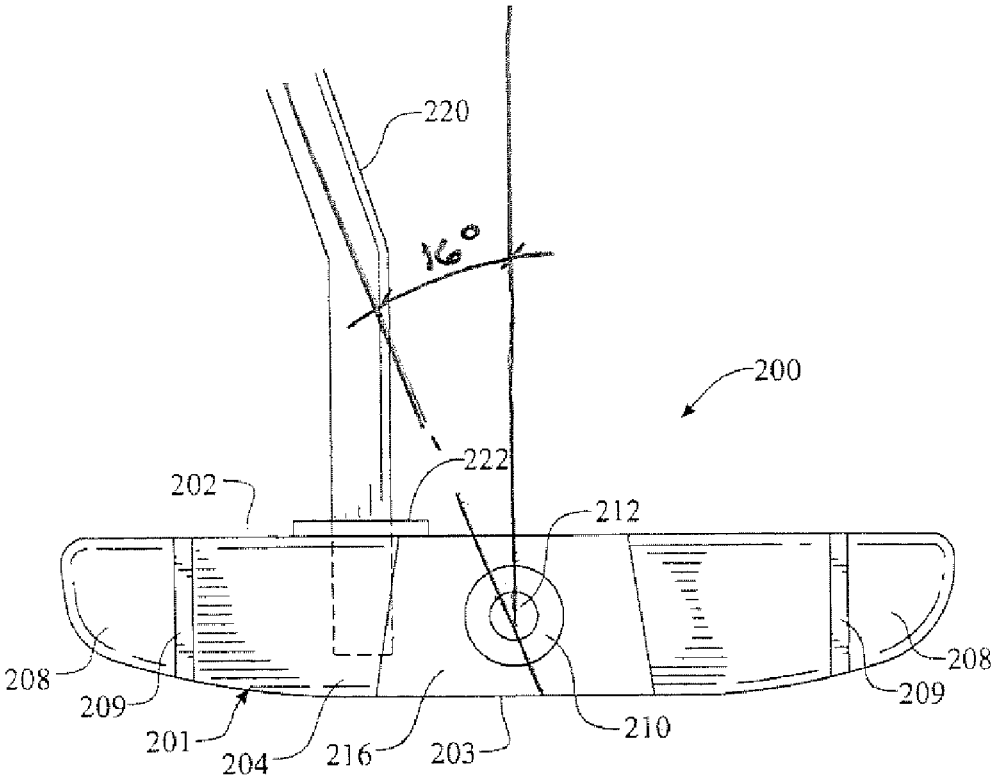
FIG. 14 illustrates an elevation view of a left hand contacting face of the golf putter originally illustrated in FIG. 13.
Figure 22:
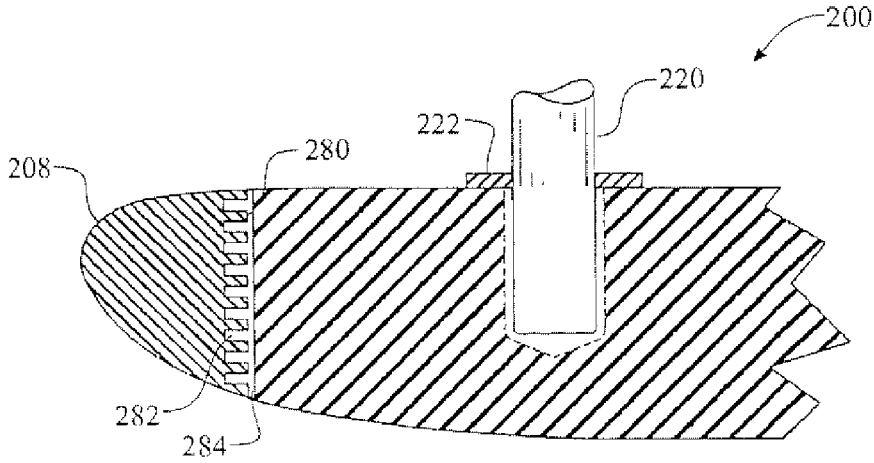
FIG. 22 illustrates a partial elevation cross-section of a golf putter club showing an epoxy bonding a toe piece to the body.

As shown in FIG. 22, and with respect to putter club 200 illustrated in FIG. 13, one or both end caps can include a plurality of fingers 280 formed in the surface that mates with main body 201 by forging, machining or other processes known in the industry. Fingers 280 define voids 282 between adjacent fingers wherein voids 282 receive therein a liquid glue 284 such as epoxy which flows into voids 282 and bonds thereto as well as bonding to main body 201. Once the glue 284 has cured and the end cap 208 is securely bonded to main body 201, putter main body 201 can be shaped to confirm to the surface contour desired for the putter 200.

The construction of the putter can be further varied as shown in a third exemplary embodiment referred to as a putter assembly 500 and illustrated in FIGS. 23 through 26. Similar to previous embodiments, the putter assembly 500 comprises a putter head 560 assembled to shaft 520 by inserting an end of shaft 520 into shaft receiving hold 521. Shaft ferrule 522 can be assembled about shaft 520 to provide aesthetics, stability, and reliability to the assembly 500. As in prior embodiments, shaft ferrule 522 can be assembled upon a putter top surface 502 of putter head 560, or within a recess about shaft receiving hold 521.

Putter head 560 has a frame or body 561 preferably formed of metal that has opposing end caps or portions 508 at a toe and heel of putter assembly 500 integrally connected one to the other in a spaced apart manner by left and right side segments or ribs 562 and 563 respectively. The body 561 also includes a chamber or void in which is received a filler segment 501. Filler segment 501 is preferably formed of an acrylic acetate material, but can be fabricated of any reasonable lightweight durable material including, but not limited to, the previously discussed marbled acrylic material. Filler segment 501 is pressed into frame 561 in a close fit manner and glued therein with glue such as an epoxy that effectively bonds the material of filler segment 501 to the material of frame 561. A series of putter centerline reference marks 518 can be provided within top surface 502 of putter filler segment 501 providing identification of the "sweet spot" when looking down onto the top of the putter. Those practiced in the art will recognize that although not shown here and as discussed with respect to putter club 200, a ball strike similar to strike 210 with an optional ball strike center reference 212 can be assembled to putter head 560 and aligned to the "sweet spot". In this manner, the putter club 500 includes a putter head 560 that has a lightweight central filler segment 501 and heavier body end caps 508 with the benefits of the higher moment of inertia as described above and further includes metal faces on both the left and right sides 562 and 563 of the club with which golfers are most familiar. While frame or body 561 was described as a metal and filler segment 501 described as an acrylic, those practiced in the art will understand that other materials can be substituted as long as the overall weight and dimensions of the putter head 560 are maintained within the weight and dimensional limits proscribed by the USGA and further that the material of frame or body 561 is substantially more dense than filler segment 501.

Figure 27:
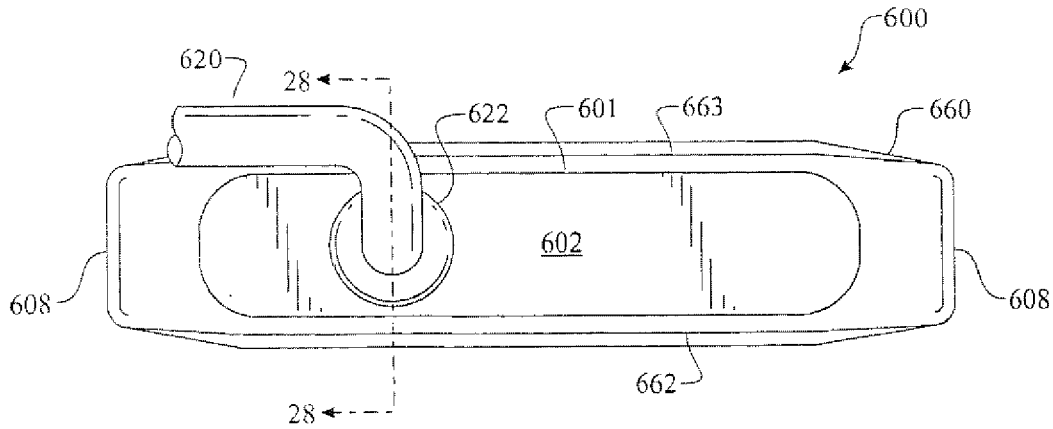
FIG. 27 illustrates a planar top view of a golf putter in accordance with a fourth exemplary embodiment of the present invention.
Figure 28:
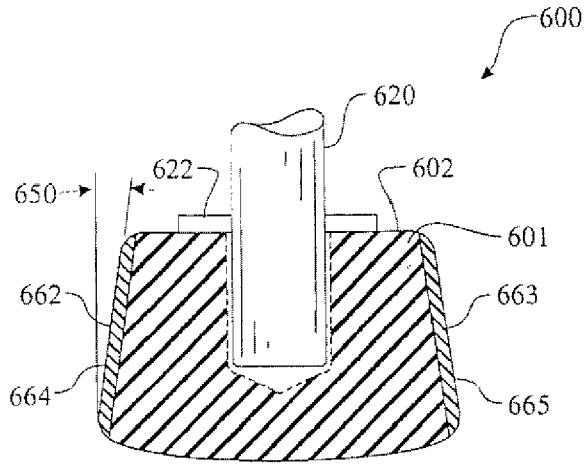
FIG. 28 illustrates an elevation cross section of the golf putter originally illustrated in FIG. 27 and taken along the line 28-28, FIG. 27.

Referring now to FIGS. 27 and 28, yet another exemplary embodiment putter assembly 600 is illustrated wherein like features with respect to putter 500 are identified with like reference numbers preceded by the numeral '6'. Putter head 660 includes a dense frame 661 at least partially defining a void filled by a less dense filler segment 601. Frame or body 661 includes end caps 608 which are interconnected and maintained in a spaced apart relationship by left and right ribs 662, 663 respectively. Similar to frame or body 561 above, body 661 defines a void into which is glued lower density filler segment 501. The faces 664, 666 of left and right ribs 662, 663 respectively can be angled providing a loft as illustrated via angle 650 of FIG. 28. As discussed with respect to putter club 200, the preferred angle would be 5 degrees.

The end cross-sectional profile view (FIG. 28) best illustrates a putter club having a putter bottom surface 603 that is wider than the putter top surface 602. The lower and upper edges can be rounded, chamfered or any other edge finish that meets USDA guidelines. The ball contact faces 664, 666 may not be rougher than a medium sand blasted mixture so as not to impart a spin to the ball other than by normal friction. Decorative grooves can be formed thereon adhering to USGA standards. Again, putter 600 includes a club head 660 that has a lightweight central filler segment 601 and heavier body end caps 608 with the benefits of the higher moment of inertia as described above and further includes metal faces on both the left and right sides of the club with which golfers are most familiar.

Figure 29:
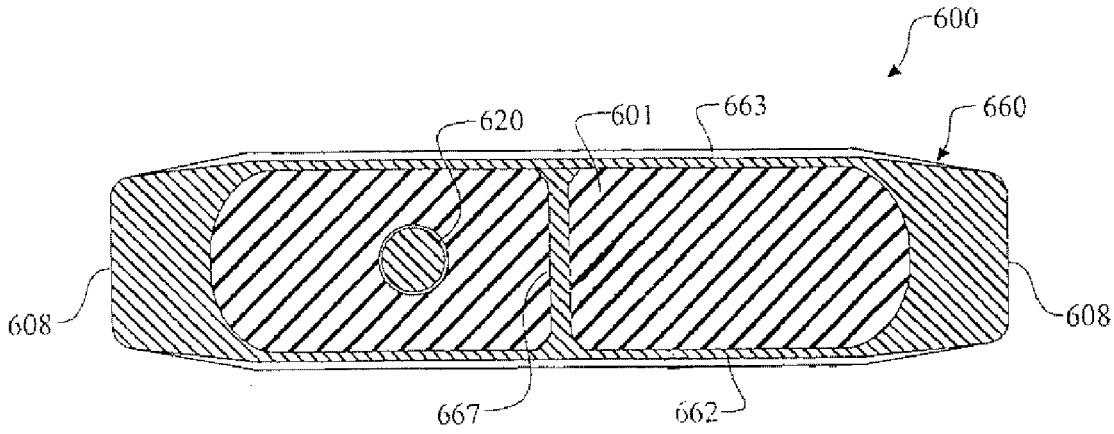
FIG. 29 illustrates an exemplary planar top cross section of the golf putter originally illustrated in FIG. 27 and further including a vertical support to rib.
Figure 30:
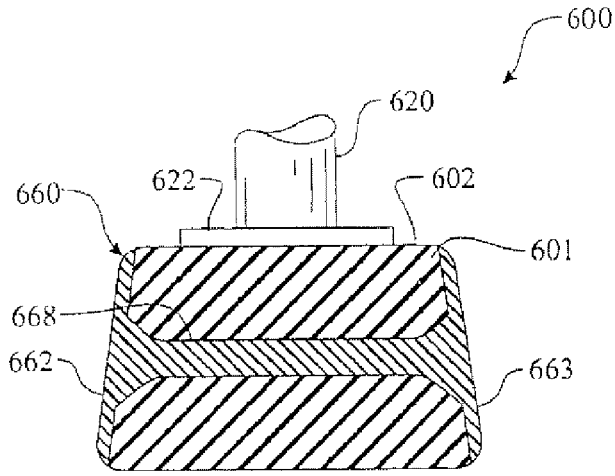
FIG. 30 illustrates an exemplary elevation cross section of the golf putter originally illustrated in FIG. 27 and further including a horizontal support rib.

For further rigidity and stability of putter heads 560 and 660, additional support ribs can be included within putter heads 560 and 660. Putter head 660 is used for illustrational purposes but those practiced in the art will recognize that the concepts presented with respect to putter head 660 are also applicable to putter head 560. As illustrated in FIG. 29, putter head 660 can also include vertical support rib 667 extending between and interconnecting left and right ribs 662, 663. Vertical support rib 667 is centrally located at mid-length of putter head 660 and most ideally passes through or in registration with the center of mass of putter head 660. FIG. 30 illustrates a second support rib configuration wherein a horizontal support rib 668 extends between and interconnects left and right ribs 662, 663. Horizontal support rib 668 is centrally located at mid-height of putter head 660 and most ideally passes through or in registration with the center of mass of putter head 660.

The development of the present invention was derived as follows:

In order to extend the end weights so they were working on a longer moment arm, it was recognized that a lightweight, but strong filler segment was needed. The filler segment needed to withstand the repeat striking force with repeated hits to a golf ball. Acrylic acetate was found to be light, just an ounce per inch, strong, yet resilient enough to not crack or shatter when striking the ball or dropped on a cart path.

The area required to preserve this strength and give sufficient area for a dependable connection to the end was 1⅜"× 1". This allowed for glue (epoxy) plus a mechanical connection between two dissimilar materials. The heavy or thick application of a soft epoxy acted as a shock gasket between the two, with the metal threaded studs 230 taking most of the shear force transmitted to the acrylic acetate filler segment 201 by a solid, but somewhat soft epoxy as an anchor at the holes as well as the face. The face being deeply abraded for maximum gluing area.

The balance of the head and the end shape was dictated by USGA design rules, such as a flat hard striking face (0.85 on a shore scale "A") durometer. The end caps 208 must be rounded sufficient so as not to count as a third and fourth "hitting face". The length of the head may not exceed seven inches. The shaft connection location can be any where along the length of the head.

It will be noted that the resulting head weights of up to as high as sixteen (16) ounces. This is purposely designed as the softer face material only gives a reaction of 75-80 percent of a metal face with a metal backing. With this weight head (14-16 ounces), the ball goes the same distance with the same stroke length that the golfer is used to. Hence, no retraining or adjustment of stroke length or speed is required. The basic design, if done with twelve ounce head design, would be five (5) inches long with three and a half ounce end weights and produces an MOI of 8,000 gm/cm2; a healthy improvement over any existing putters.

By solidly gluing a ⅛" face insert 216, about two (2) inches long, the reaction and sound is almost identical to an all metal head. This extra 1½ ounce is easily compensated for by a reduction in the speed of the golfer's stroke and executing a more deliberate stroke.

Testing was completed using "toe board" tests. This is where a ball is first struck on the sweet spot with a vertical board spiked to the ground. Then the ball is placed and hit several times with the same stroke, only with the ball closer to the board. This guarantees a half or three quarters inch mishit. When done repeatedly, gives fairly accurate comparable results. In some respects, this is a more accurate test because in the machine, the grip and shaft are rigidly restrained and not like the softer, realistic grip of the golfer. In short, the Inventor's toe board tests, done at an eighteen foot distance with a dozen balls struck "on" and the alternately "off" the sweet spot, showed no measurable difference of "fall off" or distance. Calculations suggest the clubs of the present invention have a substantially higher MOI compared to existing putter head designs. Based upon the tests and laws of physics, the expected savings in the number of putts made by the average golfer is 1-3 strokes per 18 holes.

In summary, the following benefits are provided by the present invention:

1) The putter main filler segment 101 is fabricated of an acrylic, or acrylic like material. The filler segment material is lightweight. Each of the body end cap 108 is fabricated of a metallic material, preferably Brass, thus significantly denser than the filler segment. This configuration provides an extremely high MOI, providing a high resistance to twisting, while maintaining a head that is comparable to an all-metal design. The higher the MOI, the straighter the travel of the ball. This additionally reduces any potential "fall off" due to limited torque or twisting of the club. Additionally, there is less loss of distance resulting in fewer three-putt greens.

2) Variations in the dimensions of the putter main filler segment 101 and the body end cap 108 can alter the weight and MOI.

The estimated overall weight can incorporating a denser material at each end of the less dense putter filler segment, the design provides a higher MOI.

3) The putter includes a centrally located shaft to head connection point. The club head is preferably symmetric. Offset shafting only gives a better view of the ball. It does not affect balance, weight, or MOI. The majority of the putters currently available fail to hang straight, due to a variety of design features, such as a bent shaft, offset flange, and the like. The design of the present invention allows the player to utilize the club as a plumb bob, usable about each and every axis when lightly held from the grip end, if a straight shaft is chosen.

4) The acrylic filler segment is soft enough to be machined using commonly available tools, such as a belt sander, yet durable enough to be reliably assembled to the others components. The acrylic is provided in a variety of colors and designs, making every club unique and aesthetically pleasing. The acrylic can be polished and re-polished to any of a variety of finishes. This allows the player to maintain the putter in an original condition simply by hand polishing the club. The basic shape can be easily accomplished using standard tools without the high initial cost of molds and castings. Eventually, injection molding and castings may be warranted. Several molds may be created for various head lengths.

5) The overall club dimensions can vary simply by machining the putter main filler segment 101, the body end cap 108 or both. The club can be longer, such as 5 to 7 inches, while meeting the maximum desired putter club head weight of 12 to 13 ounces. The longer face makes for easier alignment as well as increasing the MOI. Added head weight need only be in the "one ounce per inch body".

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent awl, including the doctrine of equivalents.

The present invention includes yet additional preferred embodiment represented in FIGS. 31 through 37, wherein a putter head is generally indicated as 700. The putter head includes a body 702 preferably formed of an integral, one piece construction. Moreover, the body 702 is preferably formed of a metallic material and as such may be cast into the integral, one piece construction as set forth above. Structural details of the body 702 include oppositely disposed end portions 704 and 706 effectively disposed at a toe end of the body 702 of the putter head 700 and at the heel end as represented. The integral, one piece construction of the body 702 further includes two spaced apart side segments 708 and 710 integrally connected to the opposite end portions 704 and 706. In addition, the bottom end of the head 702 may include a floor portion 712 disposed in interconnecting and/or integrally attached relation to both the opposite end portions 704 and 706 as well as the two side segments 708 and 710.

Other features of the putter head 700, specifically included in the integrally formed body 702 is provision of a chamber 714 substantially centrally disposed on or within the body 702. More specifically, the dimension and configuration of the centrally disposed chamber 714 is defined by both the opposite end portions 704 and 706 as well as the two side segments 708 and 710. Also the integrally connected floor portion 712 defines the lower or innermost boundaries of the chamber 714 such that the floor portion 712 effectively covers and/or closes the inner end of the chamber 714. In contrast, the opposite or outer end 714' of the chamber 714 is at least initially or originally open and is disposed in substantially coplanar and/or otherwise aligned relation with the exterior top or upper surface 703 of the body 702. The exterior bottom surface 702" is at least partially defined by the outer surface of the floor 712 and, depending upon the overall dimension and configuration of the body 702 of the putter head 700 the exterior bottom surface 702" can often be at least partially defined by corresponding and/or adjacent/continuous surfaces of the opposite end portions 704' and 706'.

Figure 32:
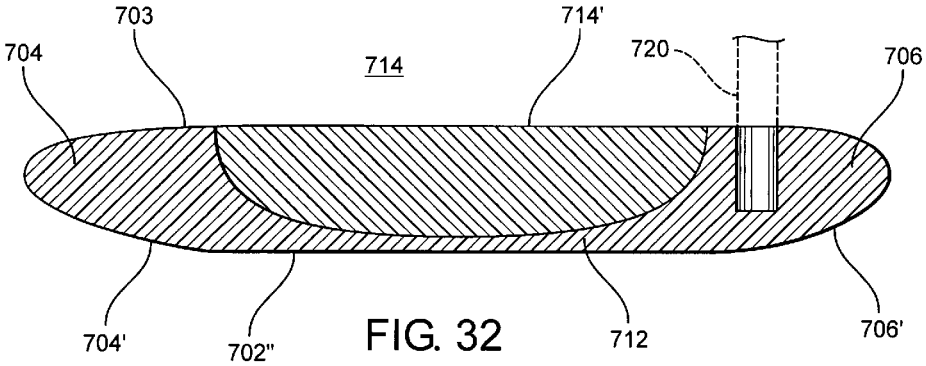
FIG. 32 is a longitudinal sectional view of the embodiment of FIG. 31 taking along line 32-32 of FIG. 31.
Figure 35:
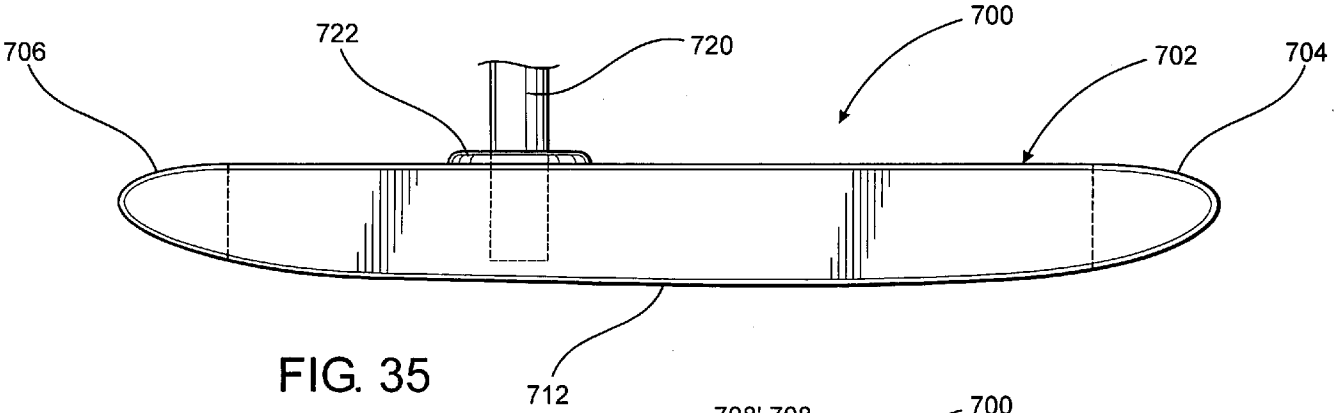
FIG. 35 is a side view of yet another preferred embodiment, similar in structure and function to the embodiment of FIGS. 31 and 32 but having dimensional modifications.
Figure 36:
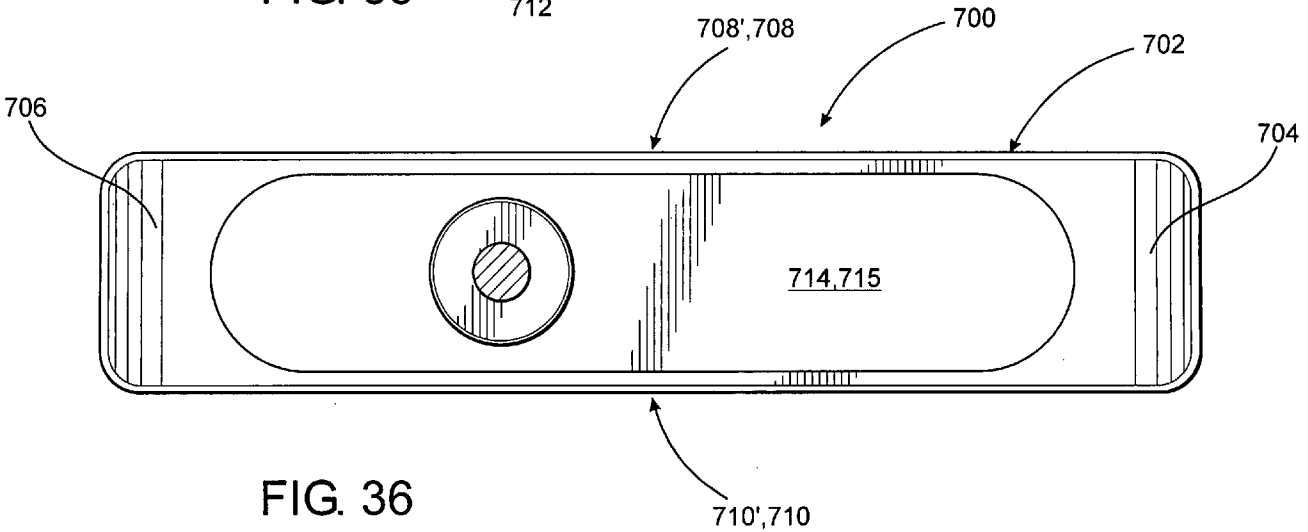
FIG. 36 is a top view of the embodiment of FIG. 35.
Figure 37:
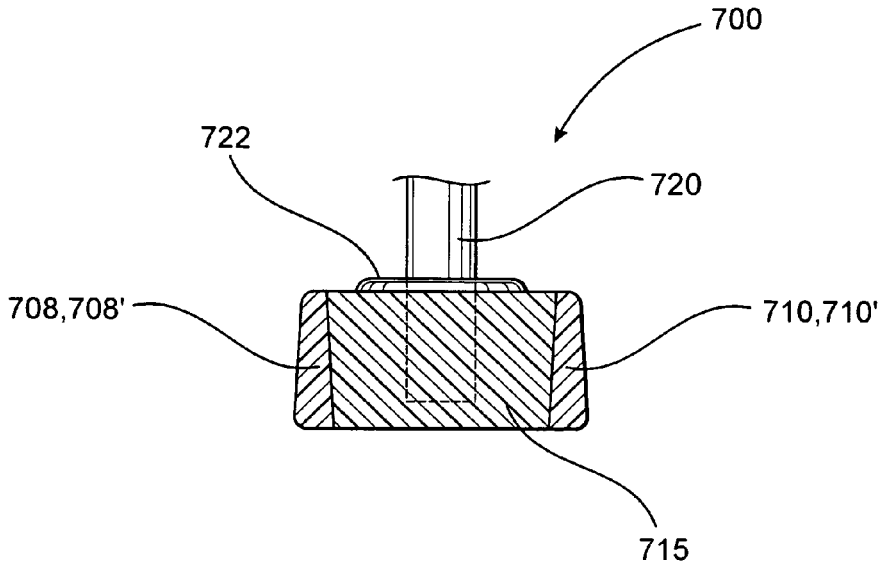
FIG. 37 is an end view of the embodiment of FIGS. 35 and 36 with additional structural modifications which may be integrated in the body of the putter head of either FIGS. 31 and 32 or FIGS. 35 and 36
Figure 38:
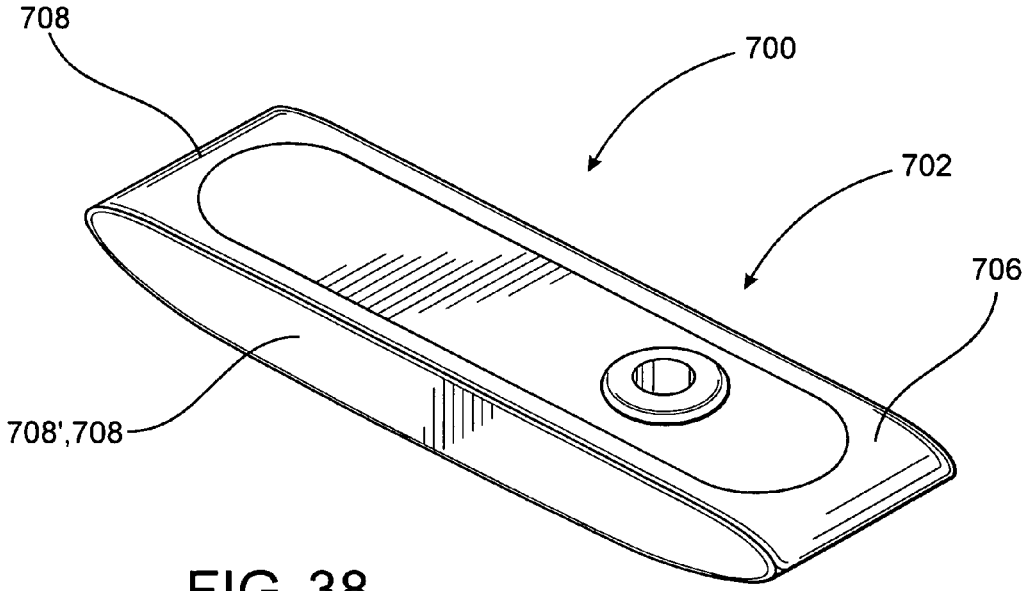
FIG. 38 is a perspective view of the embodiment of FIGS. 35 and 36.

As schematically represented in FIG. 32, a shaft 720 maybe connected at various locations to the body 702 of the putter head 700 such as by extending at least partially through the tail end portion 706. In the alternative and as represented in FIGS. 35 through 37 another embodiment of the present invention includes the corresponding end of shaft 720 extending into the interior of the chamber 714 and being secured thereto such as at least by an appropriate filler segment 715 formed of a lighter weight polymer or other appropriate material as best represented in FIG. 37 and as explained in greater detail hereinafter. As set forth above, the material from which the body 702 is formed is preferably a metallic material of a predetermined weight. Such metallic material can include stainless steel, aluminum, a variety of other appropriate metals wherein the predetermined weight thereof is at least partially determinative of the overall weight of the putter head 702 as well as the preferred MOI. More specifically, in a preferred embodiment, an important feature of the present invention is the establishment of a preferred MOI of the putter head 700. In turn the MOI may be at least partially determined by the weight of the body 702 and/or the distribution of the body weight as well as the overall configuration and dimension of the body 702 and/or portions of the body 702. As a result, a preferred MOI of the putter head 700 will be established when the body 702 has a gross weight of substantially between 10 ounces and 12 ounces. Even more preferably, the preferred weight of the body 702 is generally about 11 ounces. In addition, the preferred and significantly greater MOI is cooperatively determined by the length of the body preferably being generally about 6 inches and or even greater, such as about 7 inches, while still conforming to USGA standards.

It is of course acknowledged and recognized that the different metallic materials from which the body 702 was formed have different weights. Therefore, the establishment of the preferred 10 ounce to 12 ounce and/or 11 ounce weight of the body 702 can effectively be "regulated" or varied by an appropriate change in the dimension and configuration of the chamber 714 and or the other portions of the body including the end portions 704 and 706 and the side segments 707 and 710. The weight of the filler segment 715 is also to be considered when determining the weight of the head 702.

Figure 33:
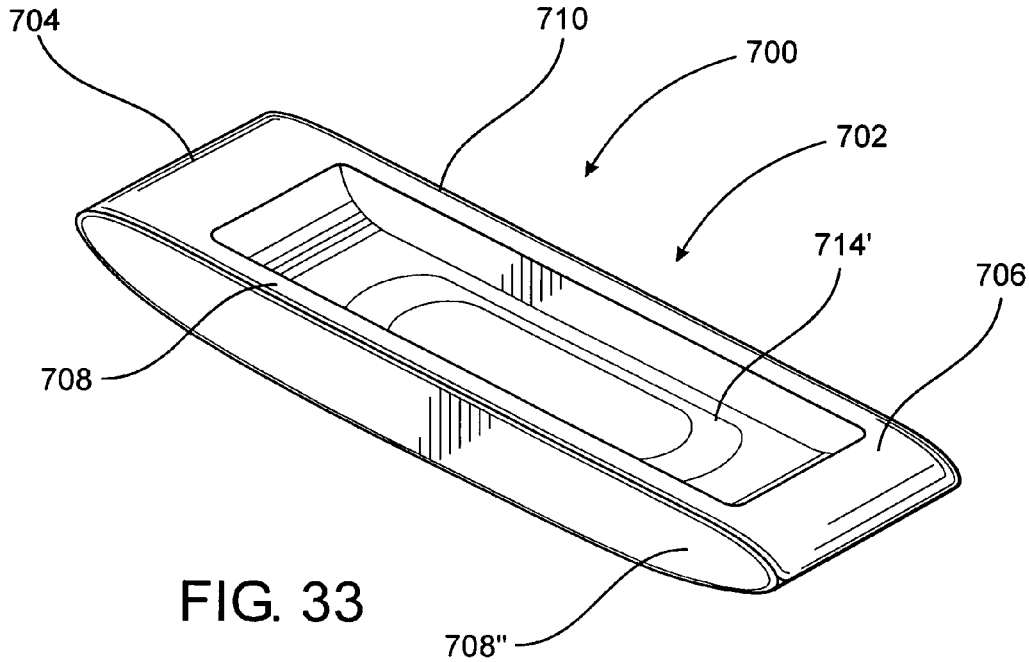
FIG. 33 is a perspective view of the embodiment of FIGS. 31 and 32 with structural modifications dependent on the overall weight and dimension of the putter head body.
Figure 34:
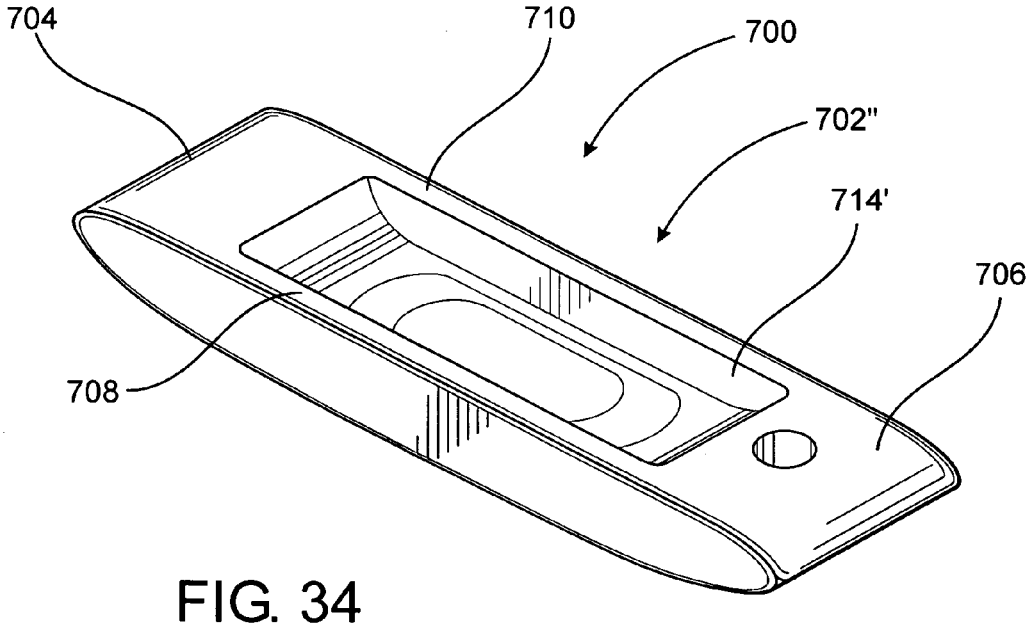
FIG. 34 is a perspective view of the embodiment of FIGS. 31 and 32 with structural modifications dependent on the overall weight and dimension of the putter head body.

A comparison of the embodiments of FIGS. 33 and 34 show the body 702' being formed of a heavier metallic material such as stainless steel. In contrast, the body 702" as represented in FIG. 34 may be formed of a lighter weight metallic material, such as aluminum. Accordingly, in order to maintain the overall weight of the putter head 700 then the 10 ounce to 12 ounce preferred range and/or the more preferred range of generally about 11 ounces, the overall dimension and configuration of the centrally disposed chamber 714' and 714" can be varied and/or predetermined during the manufacture and or formation of the body 702' and or 702".

By way of example only, the stainless steel metal from which the body 702' is formed will mandate the chamber 714' having a somewhat enlarged and/or elongated configuration as represented in FIG. 33. In contrast, the lighter weight aluminum material, from which the body 702" is formed dictates that a somewhat smaller chamber 714' be formed in the body 702". Moreover, the use of the filler segment 715 increases overall strength or structural integrity of the body 702, when used. In such a structure the inclusion of the filler segment 715 will enable a dimensional modification, such as a reduced thickness of the side segments 708 and 710. However, absent the filler segment 715 being secured within the chamber 714, the side segments will have to be made "thicker" in order to provide sufficient strength or structural integrity to the body 702.

Therefore, a general statement relative to the maintenance and determination of the preferred gross weight of the putter head 700 would be accurately defined as the heavier the predetermined weight of the metallic material from which the body 702 is formed, the larger the central opening 714 is made. In contrast, the lighter metallic material from which the body 702 is formed the smaller the chamber 714" is made. However, one feature preferably common to both the heavier and lighter putter bodies is the concentration of at least most of the gross weight of the body, collectively in the end portions, such as in the toe and heel end portions.

Additional structural and operative features associated with the putter head 700 and/or body 702 as set forth above with the embodiments of FIGS. 1 through 30. More specifically, the exterior surfaces of one or both or the side segments 708 and 710 may define a striking surface as at 708' and 710'. As such, when both the exterior surfaces 708' and 710' define striking surfaces the putter head 700 when attached to the shaft 720 may be used by either a left handed golfer or a right handed golfer. If the putter 700 is intended for exclusive use by either a right or left handed golfer, then the corresponding exterior surface of the corresponding side segments 708 or 710 will define the striking surface.

Figure 23:
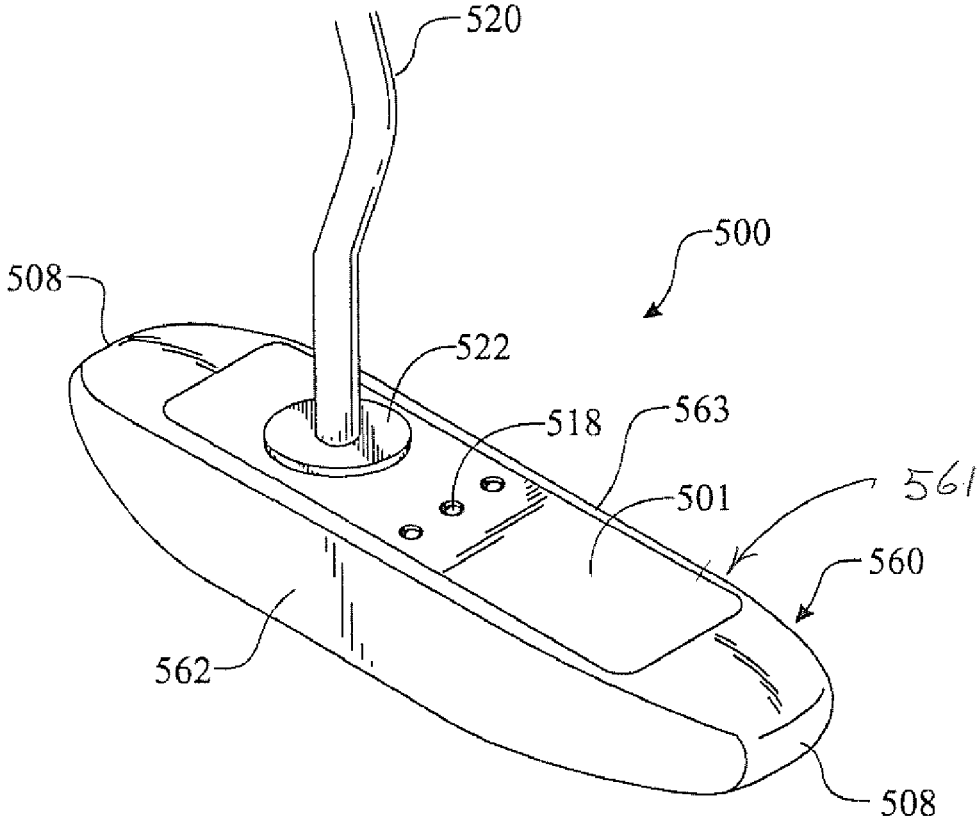
FIG. 23 illustrates an isometric view presenting a golf putter in accordance with a third exemplary embodiment of the present invention.
Figure 24:
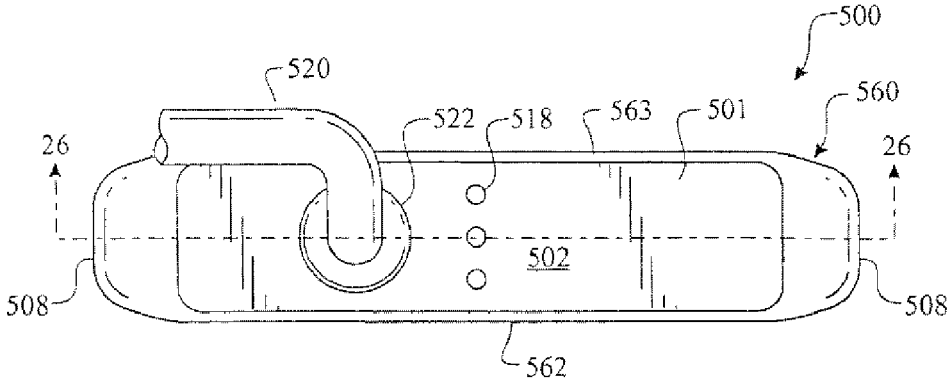
FIG. 24 illustrates a planar top view of the golf putter originally illustrated in FIG. 23.
Figure 25:
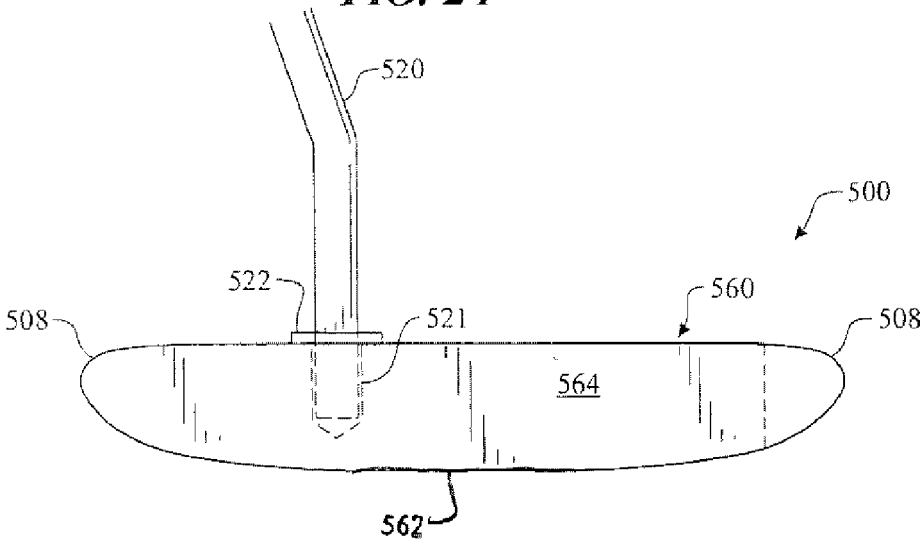
FIG. 25 illustrates an elevation view of a left hand contacting face of the golf putter originally illustrated in FIG. 23.
Figure 26:
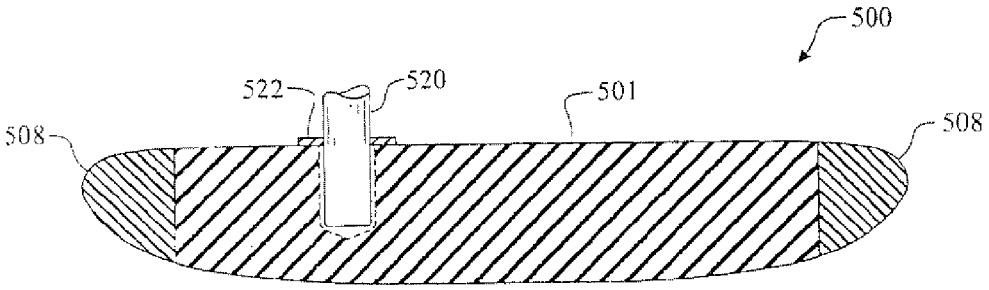
FIG. 26 illustrates an elevation cross section of the golf putter originally illustrated in FIG. 23 and taken along the line 26-26, FIG. 24.

Yet additional structural and operative features of the additional preferred embodiments of FIGS. 31 through 34 include the provision of the aforementioned filler segment 715 disposed within the chamber 714. When utilized, the filler material or segment 715 may be formed of acrylic acetate of other polymer material in whole or in part. In addition, the quantity of the filler material utilized should be such as to fill substantially the entire chamber 714 such that the outer surface of the filler material, when cured or hardened will be disposed in aligned relation to the upper or top exterior surface 703 of the putter head 702. This embodiment is at least partially similar to the embodiment of FIG. 23 and accordingly, the included filler material 715 when used to fill the chamber 714 is not represented in detail in FIGS. 31 through 34. However, the disclosure of the embodiment of FIGS. 23 and 37 provides sufficient antecedent basis for the inclusion of a filler material, as at 501 in FIG. 23 and filler segment 715 in FIG. 37.

Further with regard to the embodiment of FIGS. 31 through 37, while not specifically shown, additional features may be incorporated in the body 702 of the putter head 700 which are explained in detail with regard to at least some of the embodiments are represented in FIGS. 1 through 30 as described above in detail. By way of example only, the one or more striking faces 708' and 710' may be at least slightly angled so as to provide a desired or predetermined loft to the ball when the putter head 700 is utilized. Such a structure which accomplishes the loft of the ball as represented at least partially in FIGS. 15 and 37.

Figure 31:
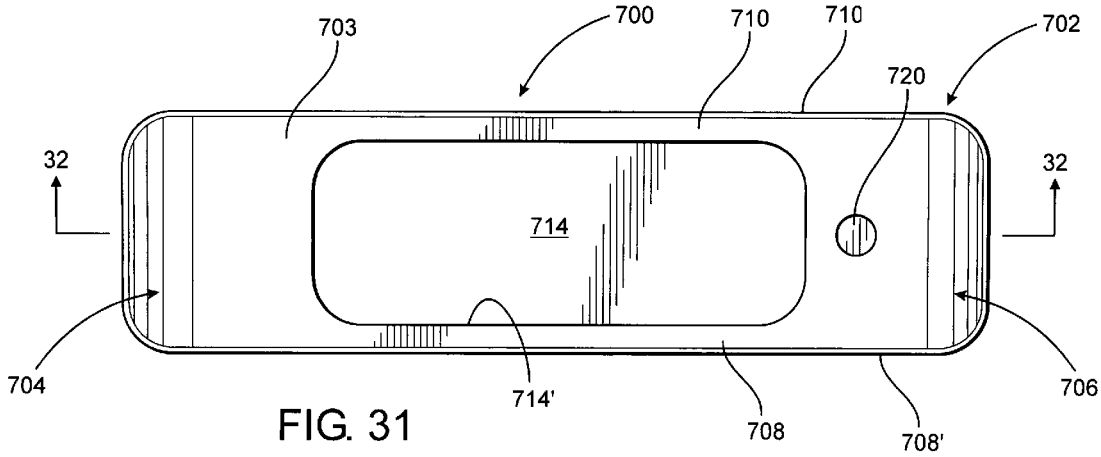
FIG. 31 is a top view of yet another preferred embodiment of the putter head.

As set forth above, the embodiment of FIGS. 35-38 is structurally and operatively almost the same as the embodiment of FIGS. 31 and 32. The exception being that the overall longitudinal dimension or length of the putter head 702 is preferably in the range of generally about 7 inches. To cooperatively accommodate the increased length of the body 702, the weight of the body 702 including the various end portions 704, 706, side segments 708 and 710 and/or filler material 715 within the chamber 714 is cooperatively adjusted or varied so as to provide an overall preferred weight of the elongated body 702 of between 10 and 12 ounces and more preferably about 11 ounces. As a result, a preferred MOI, as calculated above, will be in the range of preferably between 10,000 grams/cm2 and 13,000 grams/cm2.

Yet additional structural features include the shaft 720 and shaft ferrule 722 cooperatively disposed and arranged such that the corresponding end of the shaft 720 is embedded within and supported by the polymer material from which the filler segment 715 is formed. Such a connection of the end of the shaft is strong and stable, particularly when the outer surface of the shaft end is knurled, ribbed or otherwise roughened. This shaft connection is different from the structure of the embodiment of FIGS. 31 and 32, wherein the shaft 721 is not connected to the metallic end portions 706.

Further as noted in the above described FIG. 37, the body may be formed with the aforementioned and described integral construction, such as being cast, and still be absent a floor portion 712, as appears in the embodiment of FIGS. 31, 32, 35 and 36. However, when the floor is not included, side segments 708 and 710 are integrally connected into a one piece, integral construction with the end portions 704 and 706. Accordingly, it is emphasized that the embodiment of FIGS. 35 and 36 may or may not include the aforementioned floor 712.

Figure 39:
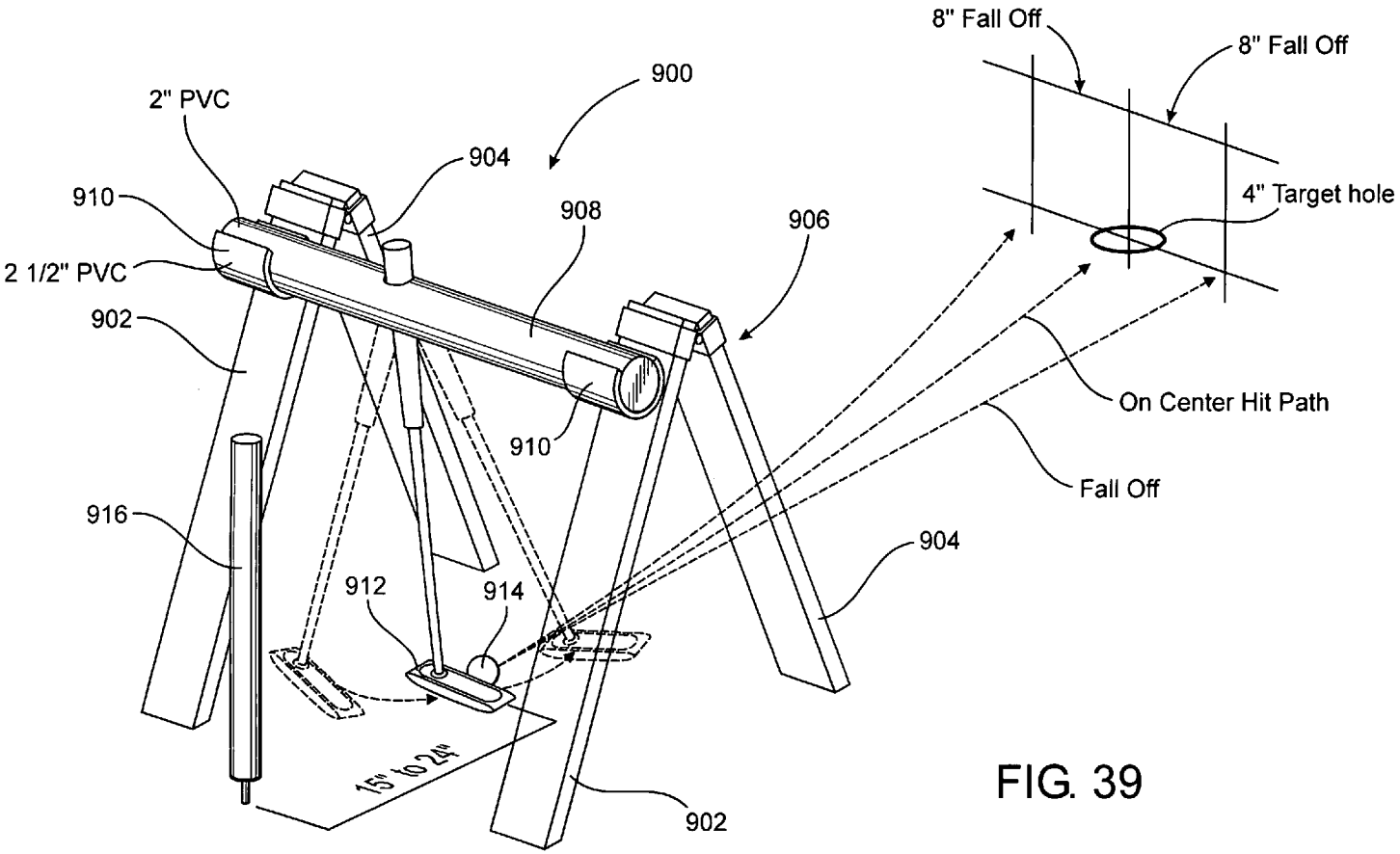
FIG. 39 is a perspective view in partial schematic form representative of a test facility used to accomplish consistent stroking of the golf ball utilizing both the various preferred embodiments of the putter head of the present invention and/or conventional golf putters.
Figure 40:
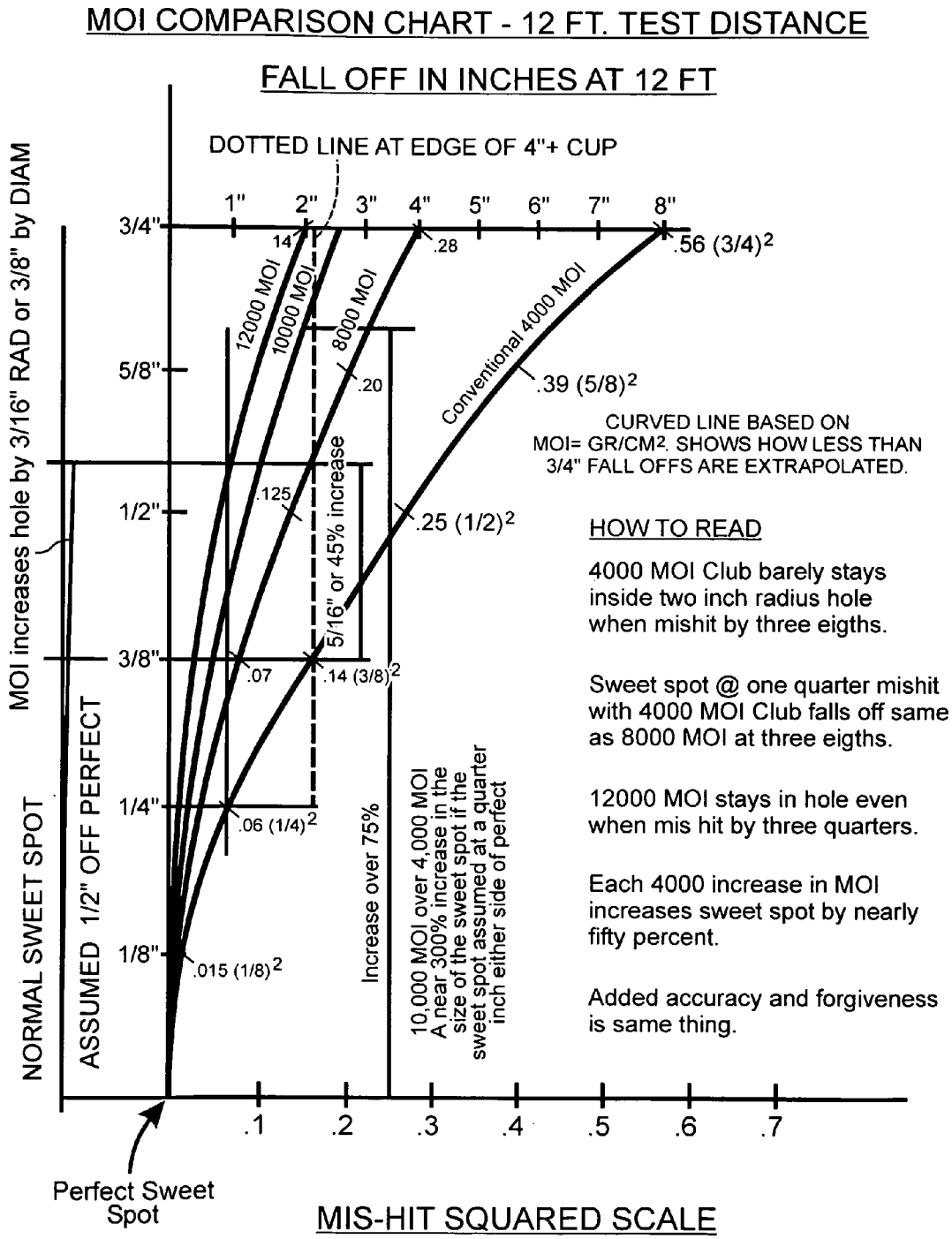
FIG. 40 is a schematic representation in graph form, with included descriptive legends, representing the results of a plurality of golf strokes, at least partially involving the test facility of FIG. 39.

With primary reference to FIGS. 39 and 40, the importance of structuring a golf club, in particular in the context of the present invention, the structuring of a golf putter head having a significantly increased MOI is demonstrated at least in terms of a striking of a ball resulting in a "fall off" or deviation from a straight line path of travel of the golf ball, as well as a "short fall" representative of the lack of intended distance of the golf ball. As indicated, both the "fall off" and the "short fall" are compared when using a golf putter head having an MOI in the range of 4,000-5,000 grams/cm2 (conventional putter head) and a putter head of the present invention, having a significantly increased MOI, generally in the range of 10,000-12,000 grams/cm2.

With general reference to FIG. 39, a test facility 900 was used in accomplishing both "sweet spot" strokes and predetermined "miss-hit" strokes. As such the test facility 900 comprises a structural configuration somewhat resembling a "saw horse" in that two leg pair 902 and 904 are hingedly connected at an upper end or base end generally indicated as 906. A club holder comprises a PVC pipe or other equivalent structure 908 pivotally or at least partially rotationally mounted in supporting brackets 910. The supporting attachment of the golf putter may occur by any type of connector or like coupling which engages the handle portion of the putter at a location which positions the putter head 912 along a path of travel which facilitates the striking of a ball 914. In order to provide consistent stroke, a stop post or other stop structure 916 may be located at a position which limits or regulates the amount of "back stroke" of the putter head.

As will be explained hereinafter, a plurality of golf balls 914 were struck a significantly large number of times in a manner which accomplished the striking of the golf ball 914 at the "sweet spot" of the putter head 912. Also, a large number of purposefully off or "miss-hits" from a predetermined distance from the sweet spot were made. In the latter performance of the "mis-hit" strokes it will be apparent, with at least partial reference to the schematical graph of FIG. 40, that the putter head 912, such as represented in the embodiments of FIGS. 1-38 and in particular in the embodiments of FIGS. 31-38, having the higher MOI resulted in a lesser "fall off" and a lesser the "short fall", as described above.

It is again emphasized that common structural and operational characteristics of the higher MOI putter heads represented in the embodiments of 1-38, and in particular 31-38, include the concentration of the heavier portions of the putter head at the end portions which is the toe end portion and the tail end portion. This is true whether the floor of the embodiments of FIGS. 31-38 is included or omitted from the structures of the putter's head represented. More specifically, at least one of preferred approach to the structural and operational characteristics of the preferred embodiments, at least as represented in FIGS. 31-38 is the casting or machining of a substantially rectangular shaped putter head body, wherein relatively thin metal side segments are disposed in spaced relation to one another about a central void or chamber. As a result the weight of the putter head will be concentrated in the oppositely disposed end portions which preferably may include weights of at least 3 to 4 ounces each. The polymer material from which the filler segment is formed provides strength and stability especially, but not exclusively, to the relatively thin side segments as described above.

Accordingly, the weight of the metal from which the putter head is formed may differ and include aluminum, stainless steel, bronze, etc. As a result, the size and configuration of the central chamber vary as well as the size and size and configuration of the other portions of the putter head body including the side segments, end portions and floor. This represents a near total reversal of the weight distribution with regard to conventional putters while preferably maintaining the weight of the putter head of between 10 to 12 ounces and preferably 11 ounces.

As disclosed in the graphical representation of FIG. 40, the test facility 900 was utilized to provide a large number of strokes wherein the golf ball was hit both on the "sweet spot" and off the sweet spot as in a "miss-hit". At a distance of 12 feet, the golf ball was purposely "mis-hit" 50 times by three quarters of an inch wherein averages and recordings were conducted every five putts. With a generally conventional putter having an MOI of 4,000 gram/cm2 the "fall off" was 8 inches on average. Utilizing a putter having an MOI of 8,000 gram/cm2, the "fall off" was 4 inches. Moreover, utilizing a putter head as represented at least in the embodiments of FIGS. 31-38, having an MOI of between 10,000 and 12,000 gram/cm2, the "fall off" was only 2 inches. Therefore, the results of this test procedure clearly indicated that the "fall off" is inversely proportional to the MOI of the club head and degree of the "mis-hit" or the distance on the striking face of the putter head between the location where the ball was struck and the "sweet spot".

Further with regard to FIG. 40, the vertical left scale shows how the "sweet spot" grows as the MOI increases. The top scale shows the one inch fall off when a 4,000 MOI blade putter is hit 12 feet. Compared with an 8 ounce MOI club hit the same distance or a half an inch "fall-off" shows that the target hole is virtually increased in diameter by a full inch by simply having a higher MOI putter head. Moreover, when a golf ball was purposely mis-hit by one quarter of an inch, 8 to 10 mid-length putts results in the conclusion that at least one stroke will be saved per round by using a high MOI type putter due to the lesser "fall off".

In regards to the "short fall" or loss of intended distance, test results indicate that a putt mis-hit by three quarters of an inch loses 10% of its distance assuming that a conventional putter head having an MOI of 4,000 to 5,000 gram/cm2 is utilized. In contrast, 50 putts similarly mis-hit by three quarters of an inch having an 8,000 MOI gram/cm2 come up 5% short. Moreover a putter head having a 12,000 MOI comes up 2 to 3% shorter when mis-hit by three quarters of an inch. As conventionally recognized, there are approximately six long putts from 30 to 90 feet in the typical 18 hold round of golf. As a result, an obvious conclusion would be that at least one three putt green would be avoided by using a high MOI putter thereby saving possibly two strokes a round.

It is again emphasized, that the MOI in grams/cm2, calculated as set forth above, utilizing the structure and operational configuration of the preferred embodiments of the putter head set forth herein would be at least a partial result of the weight of each putter head being primarily, but not exclusively, located in the opposite end portion such as the toe end and heel end which would be true whether or not the floor is incorporated in a specific preferred embodiment of the golf putter head.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A head structured for connection to a shaft of a golf putter club, said head comprising a body formed of a material of a predetermined weight, said body including oppositely disposed end portions interconnected at least by two elongate oppositely facing side segments each having a substantially uniform transverse dimension along a majority of their respective lengths, said body further including a chamber formed therein, said chamber at least partially bounded by said end portions and said side segments, said chamber including a floor disposed and dimensioned to cover a corresponding end of said chamber, said floor disposed in interconnecting relation to said end portions and said side segments, said chamber at least initially including an open end oppositely disposed to said floor and disposed in substantially aligned relation to an outer surface to said body, a filler segment disposed within said chamber in composite communication with said side segments; said filler segment formed of a material of a predetermined lesser weight than said predetermined weight of said material of said body and wherein said filler segment is dimensioned and configured to substantially fill said chamber, and a majority of said predetermined weight of said body being collectively disposed in said opposite end portions and together with a dimension and configuration of said body being collectively determinative of a predetermined moment of inertia (MOI) of said body.

2. A head as recited in claim 1 wherein said floor at least partially defines an exterior bottom surface of said body.

3. A head as recited in claim 2 wherein said exterior bottom surface is further defined by corresponding surface portions of said end portions.

4. A head as recited in claim 3 wherein each of said side segments is disposed to at least partially define a different exterior side surface of said body; at least one of said exterior side surfaces defining a striking face of said body.

5. A head as recited in claim 4 wherein each of said exterior side surface defines a different striking face of said body.

6. A head as recited in claim 1 wherein each of said side segments is disposed to at least partially define a different exterior side surface of said body; at least one of said exterior side surfaces defining a striking face of said body.

7. A head as recited in claim 6 wherein each of said exterior side surface defines a different striking face of said body.

8. A head as recited in claim 1 wherein said filler segment is dimensioned and configured to fill said chamber and said open end.

9. A head as recited in claim 1 wherein said filler segment comprises a polymer material and said body comprises a metallic material.

10. A head as recited in claim 9 wherein said filler segment is formed of an acrylic acetate material.

11. A head as recited in claim 10 wherein said body is formed of a stainless steel material.

12. A head as recited in claim 10 wherein said body is formed of an aluminum material.

13. A head as recited in claim 1 wherein said chamber and a remainder of said body are relatively and cooperatively dimensioned and configured dependent of said predetermined weight of said material of said body being such as to define said predetermined MOI of said body.

14. A head as recited in claim 13 wherein said chamber comprises variable, increased dimension and configuration dependent on a variable decrease in the weight of said body.

15. A head as recited in claim 13 wherein said predetermined weight of said body is generally about 10 ounces to 12 ounces, and wherein said body comprises an overall length of generally about between five inches (5") and seven inches (7").

16. A head as recited in claim 15 wherein said predetermined MOI of said body is generally about between 8,000 grams/cm2 and 13,000 grams/cm2.

17. A head as recited in claim 13 wherein said predetermined weight of said body and said dimension and configuration of said chamber are relatively determined to define a predetermined moment of inertia (MOI) of said body.

18. A head structured for connection to a shaft of a golf putter club, said head comprising:

a body formed of a metallic material of predetermined weight, said body including oppositely disposed end portions and two spaced apart elongate side segments integrally connected to said end portions, said side segments each having a substantially uniform transverse dimension along a majority of their respective lengths, said body further including a centrally disposed chamber including an at least initially open outer end, said chamber including boundaries at least partially defined by said end portions and said side segments, each of said side segments being disposed and structured to at least partially define a different exterior side surface of said body; at least one of said exterior side surfaces defining a striking face of said body, a filler segment disposed within said chamber in composite communication with said side segments; said filler segment formed of a material of a predetermined lesser weight than said predetermined weight of said material of said body, and said predetermined weight of said body and said dimension and configuration of said body being collectively determinative of a predetermined moment of inertia (MOI) of said body, wherein a majority of such predetermined weight of said body is collectively disposed in said oppositely disposed end portions.

19. A head as recited in claim 18 wherein said body is formed of a stainless steel material.

20. A head as recited in claim 18 wherein said body is formed of an aluminum material.

21. A head as recited in claim 18 wherein said predetermined weight of said body is generally about 10 ounces to 12 ounces and wherein said body comprises an overall length of generally about between five inches (5") and seven inches (7").

22. A head as recited in claim 21 wherein said predetermined MOI of said body is generally about between 8,000 grams/cm2 and 13,000 grams/cm2.

23. A head as recited in claim 22 wherein said filler segment comprises a polymer material and said body comprises a metallic material.

24. A head as recited in claim 22 wherein said body further includes a closed floor integrally secured to a remainder of said body in covering, closing relation to a corresponding end of said chamber.

* * * * *